US008991646B2

(12) United States Patent
Wieser

(10) Patent No.: US 8,991,646 B2
(45) Date of Patent: Mar. 31, 2015

(54) PRODUCT DISPENSER AND COVER MEMBER FOR A PRODUCT DISPENSER

(75) Inventor: Russell G. Wieser, Downingtown, PA (US)

(73) Assignee: SCA Hygiene Products AB, Gothenburg (SE)

( * ) Notice: Subject to any disclaimer, the term of this patent is extended or adjusted under 35 U.S.C. 154(b) by 297 days.

(21) Appl. No.: 13/221,136

(22) Filed: Aug. 30, 2011

(65) Prior Publication Data

US 2013/0048667 A1 Feb. 28, 2013

(51) Int. Cl.
*B65H 1/00* (2006.01)
*A47K 10/42* (2006.01)

(52) U.S. Cl.
CPC ..... *A47K 10/421* (2013.01)
USPC ..... 221/45; 221/46; 206/494

(58) Field of Classification Search
USPC ..... 221/45, 46; 206/494
See application file for complete search history.

(56) References Cited

U.S. PATENT DOCUMENTS

| | | | | |
|---|---|---|---|---|
| 4,048,050 | A | 9/1977 | Hillman | |
| 4,311,252 | A * | 1/1982 | Hope et al. | 221/57 |
| 4,969,575 | A * | 11/1990 | Kobayashi | 221/45 |
| 5,542,567 | A * | 8/1996 | Julius | 221/63 |
| 5,667,092 | A | 9/1997 | Julius et al. | |
| 6,910,579 | B2 * | 6/2005 | Reinke et al. | 206/494 |
| 7,178,689 | B2 * | 2/2007 | Wieser et al. | 221/52 |
| 7,530,472 | B2 * | 5/2009 | Bitowft et al. | 221/62 |
| 7,806,292 | B2 * | 10/2010 | Simkins | 221/63 |
| 2004/0206769 | A1 | 10/2004 | Sanders et al. | |
| 2005/0279757 | A1 * | 12/2005 | Bitowft et al. | 221/45 |
| 2009/0212063 | A1 * | 8/2009 | Cohen et al. | 221/45 |
| 2009/0255950 | A1 * | 10/2009 | Simkins | 221/45 |
| 2010/0187250 | A1 * | 7/2010 | Kryshak | 221/46 |
| 2011/0297694 | A1 * | 12/2011 | Conway et al. | 221/46 |
| 2012/0145737 | A1 * | 6/2012 | Ray et al. | 221/45 |
| 2012/0305587 | A1 * | 12/2012 | Williford | 221/46 |

FOREIGN PATENT DOCUMENTS

| | | | |
|---|---|---|---|
| EP | 1656870 | A2 | 5/2006 |
| EP | 1656870 | A2 * | 5/2006 |

OTHER PUBLICATIONS

International Search Report and Written Opinion dated Sep. 26, 2013 issued in PCT/EP2012/063558 filed Jul. 11, 2012 (12 pages).

* cited by examiner

*Primary Examiner* — Patrick Mackey
(74) *Attorney, Agent, or Firm* — Drinker Biddle & Reath LLP

(57) ABSTRACT

A product dispenser including a housing for housing dispensable products in a product reservoir defined by the housing and a cover member defining a dispensing opening through which the products are dispensed. The cover member includes a lid member and a support member and the lid member is openable relative to the support member about a hinge. The cover member is removably mountable to the housing by at least one engagement member of the support member engaging at least one complementary engagement member of the housing. A strength of connection of the hinge to the support member and a strength of connection of at least one engagement member of the support member for removably mounting the support member to the housing is such that when the lid member is opened to a stop position and further opening force is applied to the lid member, at least one engagement member dismounts between the housing and the support member before the force gets so great as to break the hinge.

29 Claims, 9 Drawing Sheets

PRODUCT DISPENSER AND COVER MEMBER FOR A PRODUCT DISPENSER

FIELD OF THE INVENTION

The disclosure relates to a product dispenser and a cover member for a product dispenser, in particular a sheet product dispenser such as a napkin dispenser. Yet more particularly, the present disclosure relates to a product dispenser that is to be positioned in the most part behind a wall member such as a counter top and is mounted to the wall member by passing the bulk of the product dispenser through a cut-out in the wall member. A dispensing opening of a cover member is exposed to a user at the front surface of the wall member so that the products are dispensable from the wall member mounted dispenser.

BACKGROUND

An exemplary counter mounted dispenser is known from US 2004/0206769 A1. In this document, a container is described for holding and dispensing individual paper sheets, such as 400 to 1000 paper sheets. The container is installed in a countertop or other suitable substantially planar surface. The container has a housing including four sidewalls and a bottom wall to define an interior space defining an interior area.

The container includes a cover that includes a dispensing opening through which the paper products pass as they are dispensed. The cover is hingedly attached to one of the sidewalls so that the cover is flush with the counter top. The cover is openable for insertion of paper products into the interior area to replenish the supply of paper products. A fastener is provided that is openable when it is desired to reopen the cover.

In this prior art container, the cover is openable to provide access to the stack of paper sheets in the interior by simply pressing a button and rotating the cover about the hinge. This design can tend to promote misuse of the dispenser. Further, the hinge is disposed at a side of the cover and the container, which is visible and which limits design flexibility to produce more aesthetically pleasing containers. Also, if the container is mistakenly mounted so that the cover is blocked from fully opening by a perpendicular wall surface next to the counter, the whole housing will need to be remounted. Yet further, the hinge mechanism of the prior art is a component that is liable to breakage, which would necessitate replacement of the whole container.

The present disclosure aims to overcome these problems and provides various aspects to address one or more of these problems.

In the prior art paper sheet container for holding and dispensing paper sheets, the housing is supported within the counter top by flanges that extend outwardly from the sidewalls. When the housing is inserted in an opening in the countertop slightly larger than the cross-section of the housing, the housing is supported within the countertop by the flanges. The flanges are fastened to the countertop by screws, nails, adhesive, etc.

These manners of securing the housing to the countertop are all methods that damage the countertop, which is not desirable for customers. It is a further aim in at least one aspect to overcome this problem.

SUMMARY

In a first aspect, there is provided a product dispenser including a product housing for housing dispensable products in a product reservoir defined by the housing, and a cover member having a dispensing opening through which the products are dispensed. The cover member is hingedly openable to allow the product reservoir to be refilled. The cover member is mountable so as to be held to the housing in a first orientation in which the cover member hingedly opens in a first direction and mountable so as to be held to the housing in a second orientation different from the first orientation in which the cover member hingedly opens in a second direction different from the first direction.

The cover member of the first aspect is able to be mounted in different orientations so that it is able to rotate about a hinge in different directions. This provides a flexibility in positioning of the dispenser since any obstructions in the opening path of the cover member for a given dispenser position could be circumvented by mounting the cover member in the different orientation.

In an embodiment, the first direction and the second direction are opposed directions. In this way, if a wall or other obstacle obstructs opening of the cover member in a first direction, the cover member can be rotated 180° about a central axis passing through a base of the housing and through the cover member to increase the likelihood of the cover member being moved into an orientation whereby opening of the cover member is not obstructed.

In an embodiment, the cover member is rotated about a central axis passing through a base of the housing and through the cover member between the first orientation and the second orientation.

The cover member covers a refill opening into the housing through which the products can be easily refilled since the opening is at least as large as the products in a stacking orientation of the products, while the dispensing opening provides a relatively restricted opening through which the products must be constricted into a reduced profile in order to pass therethrough. The cover member serves to protect the products to be dispensed from grime, dust and/or liquids and also to keep the products held in the housing as a result of the dispensing opening providing a constricted path for the products out of the dispenser.

In an embodiment, at least one protruding surface engages at least one recessed surface to mount the cover member to the housing in the first orientation and in the second orientation. This feature ensures a relatively secure mounting of the cover member to the housing in the different orientations. The protruding surface may be associated with a resiliently biased member so that the protruding surface snaps into the recessed surface. This feature provides a secure engagement of the protruding and recessed surfaces, while also allowing disengagement thereof in the event that an orientation change for the cover member is desired.

In an embodiment; the cover member includes at least one engagement member and the housing includes complementary engagement members. The complementary engagement members are located symmetrically with respect to the first and second orientations of the cover member so that the at least one engagement member of the cover member has a counterpart engagement member of the housing in the first and the second orientation of the cover member. This feature provides secure engagement between the housing and the cover member in both the first and the second orientations so that the cover member can be rotated between the orientations and there are correspondingly located engagement members in the housing. The complementary engagement members may be protruding surfaces and complementary recessed surfaces. In an embodiment, the at least one engagement member may be a plurality of engagement members and there are complementary engagement members on the housing that are symmetrically located with respect to the first and second orientations of the cover member so that engagement members of the cover member and complementary engagement members of the housing engage with one another in the first orientation of the cover member and the second orientation of the cover member. The provision of a plurality of engagement members on the cover member and corresponding ones on the housing provides secure connection between the cover member and the housing.

In an embodiment, the cover member includes a lid defining the dispensing opening and a support member. The lid is hingedly mounted to the support member and the support member is mountable so as to be held to the housing so that the cover member is mountable in the first orientation and in the second orientation.

This separation of the cover member into a hinged part (the lid) and a relatively fixed part (the support member) allows a simplified solution for a cover member that opens in two different directions since it is not the hingedly movable part that is in mounting engagement with the housing. Instead, the fixed part can simply be rotated and mounted to the housing in order to set the desired opening direction of the lid part.

In an embodiment, it is the support member that has the above described engagement members for engaging complementary engagement members on the housing.

The lid member and support member are described in further detail below. The features given below in this regard are combinable with the features of the first aspect in further embodiments and vice versa.

In a second aspect, there is provided a product dispenser including a housing for housing dispensable products in a product reservoir defined by the housing and a cover member defining a dispensing opening through which the products are dispensed. The cover member includes a lid member and a support member and the lid member is openable relative to the support member about a hinge. The cover member is removably mountable to the housing by at least one engagement member of the support member engaging at least one complementary engagement member of the housing.

The hinge is traditionally a relatively easily broken component of the cover member, particularly when it is made of molded plastic or other flexible but relatively weak material as compared to cast iron, for example. Further, during opening of the lid member a leveraging effect can occur if part of the lid member comes into contact with a fixed surface such as a counter top. This leveraging effect can overload the hinge leading to breakage. The second aspect provides the housing and the cover member of the dispenser as modular components removably mounted to one another. In this way, if the hinge or part of it were to break, i.e. snap, the cover member could be reordered and replaced without having to replace and re-mount the housing.

In an embodiment, the housing defines an opening and the support member defines an opening through which openings dispensable products can be passed to fill the reservoir when the lid member is in an open position and which openings are partially closed by the lid member when it is in a closed position. In this way, the reservoir can be filled when the lid member is opened and is closable for dispensing. In an embodiment, the support member is in the form of a frame.

In embodiments of the various aspects, the housing includes a flange and a sidewall depending from the flange so that the flange can be placed against a counter top or wall member to which the dispenser is to be mounted and so that the depending wall can be passed through a cut-out in the counter top or wall member to be located in a cavity in or behind the counter top or wall member as the flange is seated against the counter top or wall member. The sidewall provides a chute defining an interior area for receiving a stack of dispensable products. Thus, in the embodiments, the dispenser is designed to be mounted to a counter top or a wall or the like, which leaves space on the wall or the counter top because the depending sidewall of the housing, which define the reservoir, extends into the counter top or wall member and is thus hidden by it. Space behind the counter top or wall member is able to be used in such a design for accommodating the reservoir to prevent cluttering the top of the counter top or wall member with the full extent of the reservoir. Depending on the space available behind the counter top, the reservoir can be made relatively large in size without adverse effects on the space available on the counter top or wall member. The removable support member and lid member of the second aspect of the invention is particularly susceptible to such a housing design since it means that the cover member can be replaced without having to unpin the housing from the work surface and extract it from the cavity.

In an embodiment, the product dispenser includes at least one set of complementary engagement members. The support member mounts with its complementary engagement member counterpart on the housing by aligning the housing and the cover member and pushing the cover member toward the housing to cause a snap fit interengaging between the at least one set of complementary engagement members.

In an embodiment, a strength of connection of the hinge to the support member and a strength of connection of the at least one complementary engagement member of the support member and the counterpart of the housing is such that when the lid member is opened to a stop position and further opening force is applied to the lid member, at least one engagement member dismounts from the housing before the force gets so great as to break the hinge. This feature provides a pop-off cover member at least partially to prevent the lid member from being over strained during opening to the point that the structural integrity of the hinge is compromised.

In embodiments of the various aspects, the cover member is openable to a position greater than 90°, 100°, 110°, 120°, 130°, 140°, 150°, 160° or 170° relative to the housing, which provides good clearance for filling the product reservoir. In the context of the pop off cover member described above, the lid member is openable relative to the support member by these degrees, which is good for clearance but tends to provide a lever effect on the hinge which tends to increase a chance of breaking the hinge. The pop off cover member provides a solution to this problem.

In an embodiment, the support member includes a proximal end at the hinge and a distal end relative to the hinge. The support member includes at least one engagement member relatively adjacent the distal end and at least one engagement member relatively adjacent the proximal end for engaging complementary engagement members on the housing to removably mount the support member to the housing. In one embodiment, the dispenser is so that the at least one proximal engagement member of the support member disengages from the proximal complementary engagement member on the housing before the at least one distal engagement member of the support member disengages from the at least one complementary distal engagement member of the housing to provide a staged dismounting of the cover member from the housing, the proximal side before the distal side relative to the hinge.

A graduated dismounting of the cover member means that complementary engagement members can still be relatively strongly interengaging while enabling a pop-off cover member.

In an embodiment, the hinge includes a part associated with the support member and a part associated with the lid member. The support member part of the hinge is upstanding from a plane defined by a frame shaped portion of the support member. Alternatively put, the support member hinge part is provided on an overhang member spaced from a planar portion of the support member against which the lid member seats when it is in the closed position. In an embodiment, the frame shaped portion of the support member is configured to engage a frame shaped flange protruding from a sidewall of the housing. In an embodiment, the lid member seats against the support member in the closed position. It is with such an upstanding hinge part that breakage can occur. Alternatively put, a support member component of the hinge is upstanding from the general body of the support member so that the lid member has a part accommodated in a space allowed by the offset of the hinge component from the body when the lid member is in an open position.

In an embodiment, a support member component of the hinge and a lid member component of the hinge are provided, at least in part, by a complementary pivot projection and pivot recess, one of which is, formed in a peripheral lip depending from a general body of the lid member and the other of which is disposed on the support member.

In an embodiment, there are a plurality of engagement members that are symmetrically disposed so that the cover member is mountable to the product housing in a first orientation in which the lid member opens in a first direction and in a second orientation in which the lid member opens in a second direction. In an embodiment, the first and second directions are opposed to one another.

In an embodiment, the lid member is openable with respect to the support member about the hinge until a stop position is reached at which a portion of the lid member comes into engagement with a portion of the support member, wherein a further opening force tends to lift the support member from the product dispenser to disengage the at least one engagement member to thereby dismount the cover member from the product housing.

In an embodiment, the portion of the lid member is provided by a peripheral rim of the lid member depending from a general body of the lid member.

In an embodiment, the portion of the support member is provided by a protrusion from a general body of the support member. In an embodiment, the protrusion forms an overhang against which the portion of the lid member comes into contact when the lid member is in the open position. In an embodiment, a component of the hinge is disposed on an end of the overhang.

The stop position may be provided by an external surface of the lid member coming into contact with a flange of the housing or the support member as the lid member is moved to the open position. This may be as an alternative to the above embodiment where the stop surface is provided by an overhang member of the support member or in addition to it.

In an embodiment, the portion of the lid member is disposed on one side of the hinge and the majority of the lid member is disposed on the other side of the hinge.

In an embodiment, the lid member is rotatable from a closed position in which it is seated against the support member to an open position by an amount greater than 90°, 100°, 110°, 120°, 130°, 140°, 150°, 160° or 170°. This degree of opening provides full access to an opening defined by the support member through which the product housing is refilled with dispensable products. In particular embodiments, the open position is a stop position in which further opening of the lid member is blocked by engagement with a part of the support member. Providing the stop position above at these angles relative to the closed position of greater than 90° tends to naturally provide a lifting action to lift the support member from engagement with the product housing to dismount the cover member, as described above.

In an embodiment, the hinge includes a pivot pin component and a pivot pin receiving component, wherein one of the hinge components is disposed on the support member and one of the hinge components is disposed on the lid member. In an embodiment, the lid member includes a peripheral lip depending from a general body of the lid member, wherein one of the hinge components is disposed on an inner surface of the peripheral lip.

In a third aspect, there is provided a cover member for a product housing of a product dispenser including: a lid member including a dispensing opening through which products are dispensable, a hinge connecting a support member and the lid member and about which the lid member is openable for refilling the product housing and closable for covering the dispensable products in the housing. The support member includes at least one mechanical engagement member so that the cover member is removably mountable to the product housing of the dispenser. In an embodiment, the support member is frame shaped for seating against a planar upper surface (flange) of the product dispenser. The frame borders an opening through which products can be passed to fill the product housing.

In an embodiment, the at least one engagement member is one of a recess for receiving a resilient snap type member of the product housing for engaging the recess or a resilient snap type member for engaging a recess on the product housing. To engage the snap type member in a manner that is able to mount the cover member to the product housing, the recess defines a ledge against which a surface (in particular an obliquely angled surface) of the resilient engagement member seats.

In an embodiment, the lid member includes a portion positioned so that as the lid member rotates about the hinge into an open position, the portion of the lid member rotates to engage with a portion of the support member to tend to lift the support member from the housing.

The lifting force could be applied through the hinge in some embodiments. The present embodiment, however, allows the lifting force to be applied partly or wholly through a portion engaging the support member, which will tend to reduce any chance of the hinge being broken by overly straining the hinge. In one embodiment, the portion of the lid member is provided by a skirting depending from a general body of the lid member. The engagement of the portion of the lid member with the support member provides, in one embodiment, a stop position for the opening of the lid member relative to the support member. In an embodiment, an external surface of the lid member comes into contact with the support member (or a flange of the product housing) and a peripheral interior portion of the lid member comes into contact with the support member when the lid member is in the open position. This creates a lever when further opening force is applied to the lid member by which the opening force is pivotably translated about the contact between the external surface of the lid member and the support member (or the flange of the product housing) into a lifting force applied to the contact between the interior peripheral portion of the lid member and the support member, which tends to lift the support member out of engagement with the product housing.

In an embodiment, the portion of the lid member comes into engagement with the portion of the support member so that further force in the opening direction of the lid member causes a force to be applied to the portion of the support member by the portion of the lid member in a lifting direction with respect to the support member being lifted from the housing. In an embodiment, the portion of the support member includes a protrusion defining an overhang and the portion of the lid member engages the overhang when the lid member is in the open position. The portion of the lid member will efficiently operate to lift the support member from the housing if the force is upwardly directed. The overhang provides a convenient engagement surface on the support member against which the upward force can be applied. Further, the overhang is spaced from a support member to accommodate rotation of the portion of the lid member during rotation of the lid member about the hinge.

In an embodiment, the hinge is disposed adjacent one end of the lid member so that a majority of the lid member is disposed on one side of the hinge. In one embodiment, the portion of the lid member is disposed on the other side of the hinge. This arrangement provides significant lifting force from the projection on to the support member as a result of the turning moments produced by opening the lid member about the hinge. In one embodiment, the portion of the lid member comes into engagement with the portion of the support member after the majority of the lid member on one side of the hinge has rotated past a rotation of 90° in the opening direction.

In one embodiment, the portion of the lid member is provided by a peripheral lip of the lid member depending from a general body of the lid member. This construction allows the lifting force to be conveniently applied by way of a projection formed by a part of a particular design shape for the lid member, namely the peripheral lip, without having to include additional components.

In a fourth aspect, there is provided a dispensable product system including a product housing for a product dispenser that defines a product reservoir. The product housing is mountable to a counter top or wall member having an opening for receiving the product housing through the wall member and opposed major surfaces that are substantially planar. The system includes an opening through a side wall of the housing and a protrusion member positionable from a non-blocking position to a blocking position in that the protrusion member is positionable through the opening from an inside of the side wall of the product housing to project from an outside of the side wall of the product housing for seating against one of the major surfaces of the wall member to block movement of the product housing with respect to passing through the opening in the counter top or wall member in a first direction.

Product housings have traditionally been anchored to a wall member, such as a counter top, using screws or adhesive. Such anchors can permanently deform a surface of the counter top or wall member, which is often not desirable. The fourth aspect provides a convenient way of anchoring a product housing with respect to a counter top or wall member that does not suffer from such drawbacks. In particular, the product housing can be passed freely through an opening or cutout in the counter top or wall member with the projecting member in a removed or retracted position to get the product housing conveniently in a desired mounting position. Subsequently, the projecting member can be positioned through the opening to project from the outside of the sidewall from the inside of the product housing, which makes for easy installation. Further, the anchoring is done by the projection member being seated against a major surface of the counter top or wall member, which is a damage free method.

In an embodiment, the projection member includes a catch portion engaging with the outside of the side wall to resist movement of the projection member from the blocking position to the non-blocking position.

In an embodiment, the catch portion is deflectable to allow the catch portion to pass through the opening and is so as to deflect back under a resilient bias to allow the catch portion to engage with the outside of the sidewall once the catch has passed through the opening and into the blocking position.

In an embodiment, the projection member includes a distal end portion that is for projecting from the outside of the sidewall and a proximal portion that is for abutting the inside of the sidewall in the blocking position.

In an embodiment, the proximal end defines a flange and the projection member and the opening are sized such that the flange abuts against the inside sidewall when the projecting member is in the blocking position. In an embodiment, the proximal end of the projection member is graspable by a user from the inside of the product housing to move parts thereof together to release a catch so that the projection member is released to be moved from the blocking position to the non-blocking position.

In an embodiment, the projection member is formed in a general U-shape with the bight of the U-shape forming the distal end and the legs of the U-shape forming the parts that are moveable toward one another. The parts of the projection member that are moveable toward one another are resiliently biased to return to the state in which the catch is engageable with the sidewall to resist movement of the projection member from the blocking position to the non-blocking position. In an embodiment, the projection member tapers from the distal end to the proximal end so that the distal end is more easily accommodated by the opening in the sidewall as the distal end passes through the opening and the fit of the projection member in the opening at the proximal end becomes tighter.

In an embodiment, as the projection member passes through the opening, the parts of the projection member are squeezed together by the sidewall defining the opening to allow the catch to pass through the opening in the distal direction. A resiliency in the projection member causes the catch to engage on the outside of the sidewall once the catch has passed through the opening.

The projection member described above is easy to mount since it can be placed conveniently through the opening until the flange contacts the inside of the sidewall and the catch contacts the outside of the sidewall. A resiliency in the projection member allows for an automatic engagement of the catch. In this way, the blocking position of the projection member is fixed. The projection member is also relatively easily moved out of the blocking position by moving the parts together to disengage the catch. Further, the tapered shape of the projection member means that the distal end fits easily into the opening and as is passes through. The sidewall defining the opening will tend to squeeze the parts together to allow the catch to pass through the opening and catch on the other side by the resiliency, without the user having to manually bring the parts together.

In an embodiment, the product housing includes an opening through which the products pass during dispensing, which is positioned at a top of the product housing. In an embodiment, the sidewall includes a plurality of openings spaced in a top to bottom direction so that at least one projection member is positionable through each of the openings in the blocking and non-blocking positions in order to accommodate different counter top or wall member thicknesses, wherein the thickness of the counter top or wall member is in the direction between the major surfaces.

The presence of a plurality of openings allows the non-damaging mounting method of the housing of the present aspect to be applied to a number of different thickness counter tops or wall members. In this way, the same design product can be supplied to a number of different end users and it is still able to be securely mounted to the counter top or wall member even if each end user has a different counter top or wall member thickness to which the product housing is to be mounted.

In an embodiment, the at least one projection member is removeable from one of the openings to the non-blocking position and positionable in another of the openings to the blocking position. Such a removable projection member means that one such member can be used for a plurality of openings to allow accommodation of a range of thicknesses of counter tops or wall members in a low complexity manner.

In another embodiment, there is provided a plurality of columns of openings through the sidewall of the product housing that are offset from one another so that the openings in a first of the columns are offset in the top to bottom direction from the openings in a second of the columns. In this way, there is a reduced interval between each possible thickness of counter top or wall member that can be accommodated so that the counter top or wall member is more securely engaged by the projection member.

In an embodiment, the sidewall includes a part for contacting and positioning an edge of a stack of products being held by the product housing and a recessed part of the sidewall that is recessed so that a portion of at least one projection member in a blocking position sticking out on the inside of the sidewall is provided in a space defined between the recess and the edge of the products. In this way, the portion of the projection member is able to stick out far enough to allow a user to easily grasp it and manipulate it to the non-blocking position, while avoiding interaction with the stack, which could damage the stack or interfere with successful product dispensing. In an embodiment, the recessed part and the contacting part are formed by suitably shaping the sidewall so that the outside forms a bulging part corresponding to the recessed part on the inside and a depressed part corresponding to the contacting part on the inside. This allows the thickness of the sidewall to remain relatively thin, while the shape of the sidewall provides improved strength.

In an embodiment, the product housing includes a flange at a top end, wherein the top end defines an opening into the product housing through which a product is dispensable and through which the product reservoir is refillable. The flange is for seating against a top surface of the major surfaces of the counter top or wall member with the product housing extending through the counter top or wall member so that the sidewall extends through the counter top or wall member and into a cavity behind the counter top or wall member. The flange can be sized large enough so that the sidewall fits through a number of different size openings or cut-outs in the counter top or wall member while the flange still seats on the top surface of the counter top or wall member even for the largest of a range of compatible opening sizes.

In an embodiment, the flange is for seating on the top surface of the counter top or wall member to prevent the product housing from being able to pass through the opening in the counter top or wall member in a second direction and the projection member is for seating against a bottom surface of the counter top or wall member for blocking movement of the product housing in the first direction. The counter top or wall member is thus clasped in the thickness direction of the counter top or wall member between the flange and the projection member to prevent the product housing being pushed behind the counter top or wall member and to prevent the product housing from moving in the dispensing direction during dispensing.

In an embodiment, there is at least one first opening on a sidewall of one side of the product housing and at least one second opening on a sidewall of another side of the product housing that is opposed to said one side and corresponding first and second projection members positionable between the blocking and non-blocking positions respectively through the first and second openings.

The provision of opposed openings and projection members ensures that both sides of the product housing are secured to the counter top or wall member. In an embodiment, there is further at least one third opening in a sidewall of the product housing and at least one fourth opening in a sidewall of the product housing opening and respective third and fourth projection members. The first, second, third and fourth openings are distributed so as to seat the respective projection members against the major surface of the counter top or wall member at locations distributed around the product housing. In an embodiment, the first, second, third and fourth openings are provided in respective quadrants of the product housing with respect to a central axis passing from a bottom of the product housing to a top of the product housing defining an opening through which the product exits the product reservoir during dispensing.

In an embodiment, the at least one first and second openings or the at least one first, second, third, and fourth openings are a set of first openings and a set of second openings or a set of first openings, a set of second openings, a set of third openings and a set of fourth openings, wherein the openings in each set are spaced in a top to bottom direction to enable accommodation of different thickness counter tops or wall members.

In an embodiment, the openings in each set are arranged in first and second columns, wherein the openings in the first column are offset from the openings in the second column in a top to bottom direction of the product housing.

In an embodiment, each set of openings is provided in a respective recessed section of the sidewall with respect to the inside of the sidewall.

The housing of the fourth aspect is combinable with a cover member as described above with respect to the first to third aspects, as will be clear from the following detailed embodiment in which the features so far described are combined in a dispenser. It is also combinable with a more conventional cover member for an in-counter dispenser.

In a fifth aspect, there is provided at least a part of a dispenser housing and a cover member. The dispenser housing defines a product reservoir for containing dispensable products. The part of the dispenser housing defines an opening through which products are dispensed from the product housing and through which the product housing is refillable. The cover member is positionable between an open position in which the opening of the dispenser housing part is revealed for refilling the product reservoir with dispensable products and a closed position in which the opening of the dispenser housing is covered for dispensing, and the cover member includes a dispensing opening through which products are dispensed when the cover member is in the closed position. The cover member is moveable relative to the part of the dispenser housing by way of a mechanism in which a projection rides along a guide between a first position in which the cover member is held closed to the part of the housing to resist opening of the cover member and a second position in which the cover member is openable relative to the part of the dispenser housing to the open position.

The fifth aspect thus provides a way of orienting a cover member into a closed and latched position and into an open position by moving the cover member relative to the part of the product housing. This provides an easy to open and an easy to lock and close mechanism that does not require special keys or other tools, yet the closed position is still suitably resistive to the cover member being opened since the operative has to have the knack of moving the pin in the guide in order to make the cover member openable. A refilling operation is thereby potentially sped up without compromising a tamper resistance of the dispenser.

The part of the dispenser housing may be a support member as described above that is modular with respect to a product housing or a part of an otherwise conventional product housing of a dispenser. That is, the fifth aspect could be directed to a modular cover member and support member piece or a dispenser including a product housing and a cover member.

In an embodiment, the cover member is moveable relative to the part of the housing between the first and second positions by way of a pin and groove mechanism.

In an embodiment, the guide includes a pivot depression, wherein the projection is located in the depression when the cover mechanism is in the second position to form a hinge about which the cover member is rotatable to the open position. In this way, the guide and projection mechanism serves both to guide the cover member between the openable and held closed positions and also is used as a hinge component about which the cover member is opened. In an embodiment, the projection is biased so as to resiliently clip in to the depression as the projections runs along the guide to the depression and to provide resistance to the projection moving out of the depression to run back along the guide. According to this feature, the location of the hinge is stable as a result of the depression and biased projection.

In an embodiment, in the first position, the cover member is held to the part of the dispenser housing by engagement between surfaces resisting movement of the cover member in a direction to open the cover member to the open position from the closed position, and in the second position, the cover member is moved so that the surfaces come out of engagement with one another to allow the cover member to be opened to the open position. In an embodiment, the surfaces resisting movement of the cover member in an opening direction are disposed at an opposed end of the cover member to the hinge so as to be positioned distally with respect to the hinge. This embodiment ensures that the cover member is securely held to the part of the body by the engaging surfaces because they prevent rotation about the hinge at a location away from the hinge.

In an embodiment, the cover member includes a peripheral lip, depending from a general body of the cover member, wherein one of the guide and the projection are provided on an inside surface of the peripheral lip. This feature ensures that the working components for opening and closing the cover member are concealed from a user, which may be aesthetically positive and may also aid in preventing an uninformed user from the working out the knack for opening the cover member from the closed position when it is in the first position relative to the part of the housing.

In an embodiment, there is provided a second guide and projection mechanism at an opposed end of the cover member to the hinge so that when the cover member is in the second position relative to the part of the housing, the projection enters the guide. When the cover member is rotated about the hinge to move the cover member from the open position to the closed position, the first and second projections are able to run along the respective guides to move the cover member to the first position relative to the part of the housing in which position the second guide acts on the second projection to block movement of the opposed end of the cover member about the hinge to thereby hold the cover member closed. When the cover member is moved back to the first position, the second guide is structured to free the projection from the guide so that the cover member is able to move from the closed position to the open position by rotation about the hinge.

This dual guide and projection mechanism provides a smooth operation of the cover member between the first and second positions and a convenient to manufacture but effective system for allowing the cover member to be opened and closed.

In an embodiment, the cover member includes a second guide and projection mechanism, wherein the second guide is open at one end to allow the cover member to move between the open and closed positions when the cover member is in the second position and which is closed at the other end to block movement of the cover member from moving from the closed position to the open position when the cover member is in the first position.

In an alternative embodiment, the cover member and the housing part includes a cooperating catch mechanism that blocks movement of the cover member from the closed to the open position when the cover member is in the first position and which comes out of engagement when the cover member is in the second position to allow opening of the cover member from the closed position to the open position.

In an embodiment, the guide of the guide and projection mechanism is shaped so that the cover member is raised relative to the part of the housing as the cover member is moved relative to the part of the housing from the first position to the second position. This feature accommodates movement of the cover member from the closed position to the open position.

In an embodiment, the guide of the guide and projection mechanism is shaped so that the cover member moves toward the part of the housing when the cover member is moved relative to the part of the housing from the first position to the second position. This feature ensures a tight mating between the cover member and the part of the housing when the cover member is in the closed position and moved to the second position in which the cover member is held to the part of the housing.

Thus, the guide and projection mechanism is a cam guide and projection mechanism for guiding the movement of the cover member between the first and second positions in a way that raises the cover member relative to the part of the housing and moves the cover member toward the housing as the projection member rides along the cam guide.

The guide and projection mechanism and the manner by which the cover member is openable and closeable relative to the part of the housing are combinable with the respective features described above with regard to the first to fourth aspects.

General features of the various aspects follow.

According to embodiments, the dispenser housing defines a product reservoir for holding a stack of products stacked in a direction aligned with a top to bottom direction of the product housing. In embodiments, the at least one sidewall defines the product reservoir and is essentially an elongate sleeve, wherein the products are stackable in the longitudinal direction of the sleeve.

In embodiments, the product reservoir is for containing a stack of sheets for wiping, such as napkins. In embodiments, the housing is large enough so that the product reservoir is able to hold a stack of 100 or greater, 200, 300, 400, 500, 600, 700, 800, 900 or 1000 or greater sheet products or napkins. In embodiments, the sheets are interfolded so that, generally, as one sheet is pulled through the dispensing opening, the succeeding sheet in the stack follows the one sheet.

In embodiments, the dispenser includes a platform on which the stack of products is placed so that the bottom product in the stack rests on the platform and the top product in the stack is closer to the dispenser opening. In embodiments, the platform is moveable toward and away from the dispenser opening to accommodate different size stacks in the stacking direction. In embodiments, the dispenser includes a spring mechanism to bias the platform toward the dispenser opening so that the top product in the stack is positioned at the dispenser opening even as the stack depletes.

In an embodiment, a base of a product reservoir housing includes a coil receptacle into which at least one coil of a spring is receivable in order to hold the spring at the base of the product reservoir in an axial direction of the spring and also to define a circumferential position of the spring relative to the housing. In particular embodiments, an underside of the platform includes a coil receptacle for holding at least one coil of the spring to the platform in an axial direction of the spring and also for defining a circumferential position of the spring relative to the platform. In particular embodiments, the receptacle is provided by a plurality of circumferentially spaced receptacle parts. The circumferential spacing provides radial openings in the receptacle for ease of assembling the spring to the product housing and the platform. This advantageous design for accommodating the spring for biasing the platform toward the dispensing opening is an independently applicable contribution to the art in addition to the above described independent contributions (aspects).

In embodiments, the at least one sidewall and the platform include at least one channel and at least one cooperating protrusion for riding in and being guided by the channel. In embodiments, there is a plurality of corresponding protrusions and channels located at respective corner portions of the platform.

In embodiments, the platform defines a bulbous central area for pushing a central area of a stack toward the dispensing opening, wherein the central area is an area located about a central axis passing through each of the products in the stack. In particular embodiments, the cover member defining the dispensing opening is roof-shaped or otherwise defines an internal concavity into which the bulbous central area projects when the platform is in a top position adjacent the dispensing opening. This feature allows a roof shaped cover member to be used while still allowing all products in a stack to be dispensed. This feature is deemed to offer an independent contribution to the art in addition to the above described independent aspects.

In embodiments, the platform includes at least one upstanding member positioned at a periphery of the platform for aligning the products on the platform.

In embodiments, the product housing may be made of two molded identical halves that respectively have cooperating mating components. The halves may be brought together and the cooperating components brought into mating engagement to define the complete housing. This offers significant manufacturing advantages as compared to prior art arrangements. Each half of the product housing may include a base half, a sidewall half and a flange half, wherein the sidewall half extends between the base and the flange and the complete flange is for seating against a counter top or other wall member when the complete sidewall is positioned through a cutout in the counter top or other wall member. Forming the product housing in identical halves is an independently advantageous contribution to the art.

The grooves are for cooperating with pin members on the frame member to define a position in which the lid member can be opened relative to the frame member and to define a position in which the lid member is held in a closed position and in which position the lid member cannot be opened relative to the frame member. The grooves are further angled so that the lid member moves closer (in a direction normal to a plane defined by a general body of the support member) to the frame member when it is closed and moves further away from the frame member when the lid member is in a position in which the lid member is openable.

Figure 1:
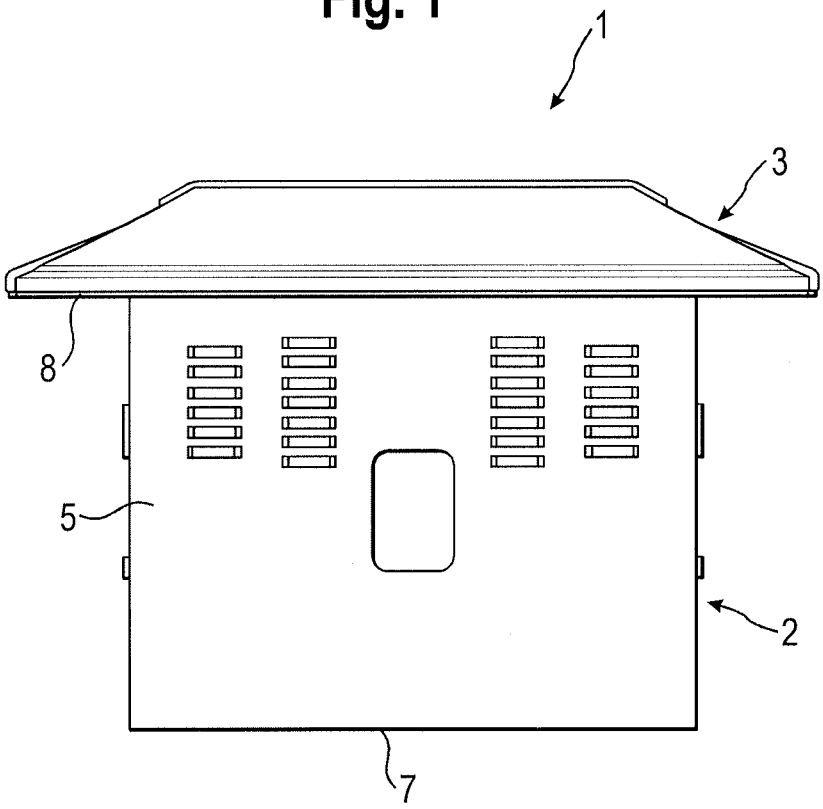
FIG. 1 discloses a dispenser according to an embodiment. A sidewall of the dispenser is shown, which defines a product reservoir. The sidewall includes four columns of slot-like openings for receiving through them a peg for engaging the underside of a counter top or other such wall member. The dispenser includes a cover member that closes a refill opening defined by an entrance to the product reservoir encompassed by the sidewall.
Figure 2:
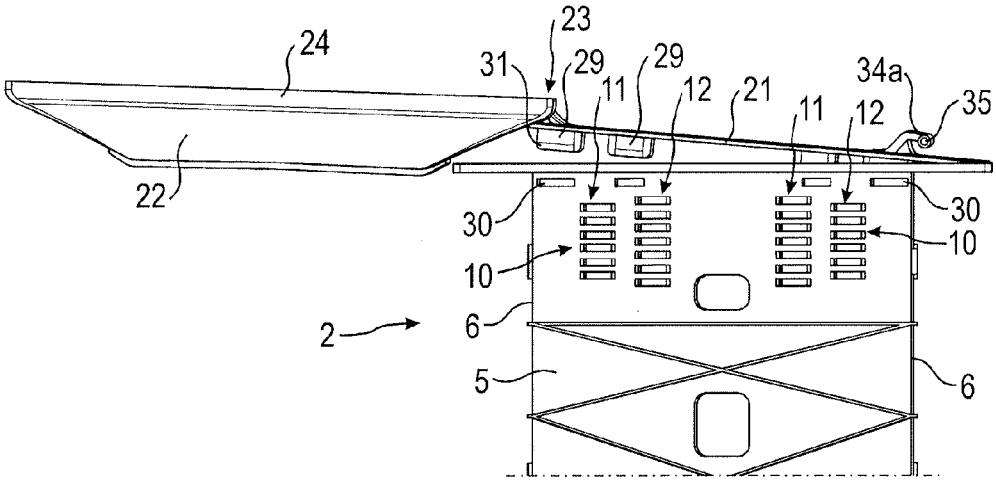
FIG. 2 shows an embodiment of the cover member in which a lid member is provided in an open position relative to a frame-like support member. The frame member includes tabs that are resiliently engageable with openings in a sidewall of the dispenser to secure the cover member to a product housing including the sidewall. If an opening force is over exerted on the lid member, the engagement tabs will disengage from the sidewall before the hinge is broken or the lid member becomes unhinged relative to the frame member.
Figure 3:
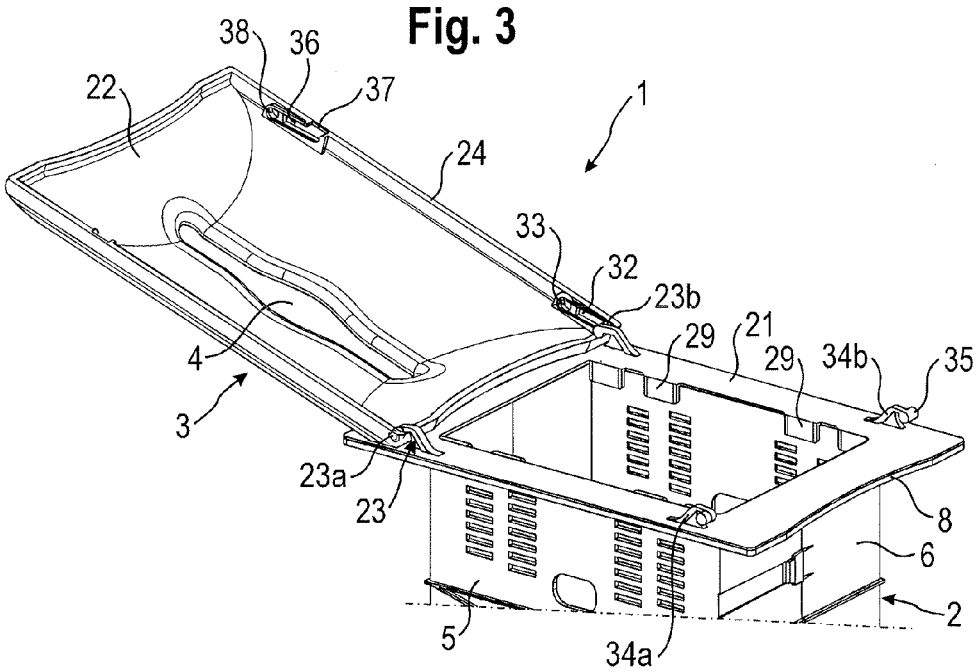
FIG. 3 shows a perspective view of the dispenser of FIG. 2 in which grooves of an inside surface of the lid member can be seen. These grooves serve to define a shift and pivot opening method to open the cover member relative to the housing and a pivot and shift closing method to move the cover member into a locked state relative to the housing.
Figure 4:
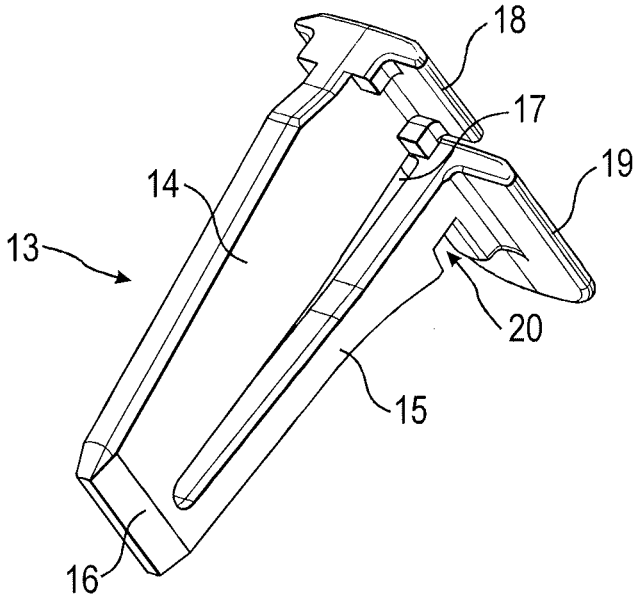

FIG. 4 shows a peg that is to be positioned through one of the mounting openings in the sidewalls of the product housing shown in FIGS. 1, 2 and 3 for seating against an underside of a counter top or other such wall member. The peg includes legs that are able to be resiliently moved towards one another so that the peg can be moved through the openings in the sidewalls and which snap fit into engagement with the sidewall through a notch in one of the legs.

Figure 5:
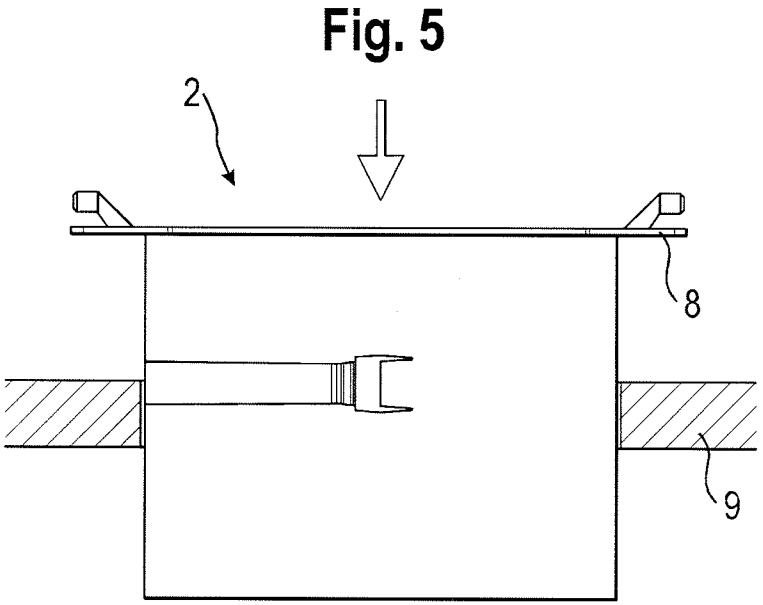
Figure 6:
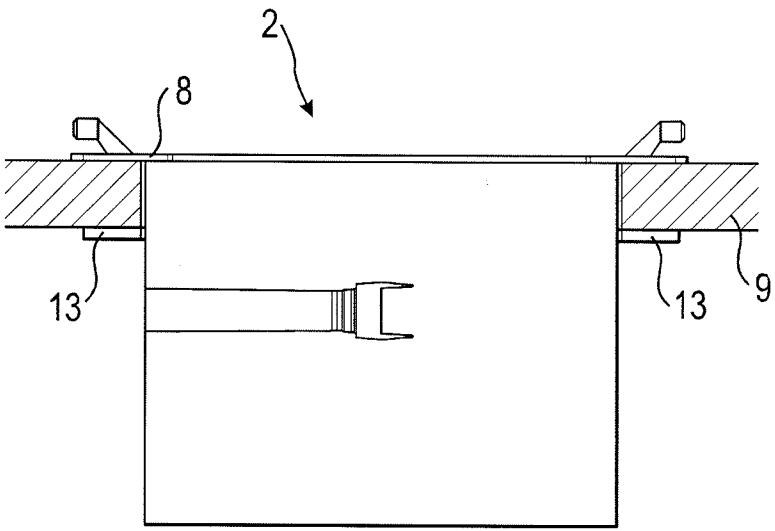

FIGS. 5 and 6 show a process of inserting the dispenser housing through a cut-out in a counter top or other such wall member until a flange positioned at the top of the sidewall of the dispenser housing rests against a top surface of the counter top. Mounting is completed as shown in FIG. 6 by insertion of a plurality of pegs through the openings in the sidewalls of the product housing in a position so as to seat against an under surface of the counter top. In this way, the product housing is secured in an upward and downward direction with respect to the counter top.

Figure 7:
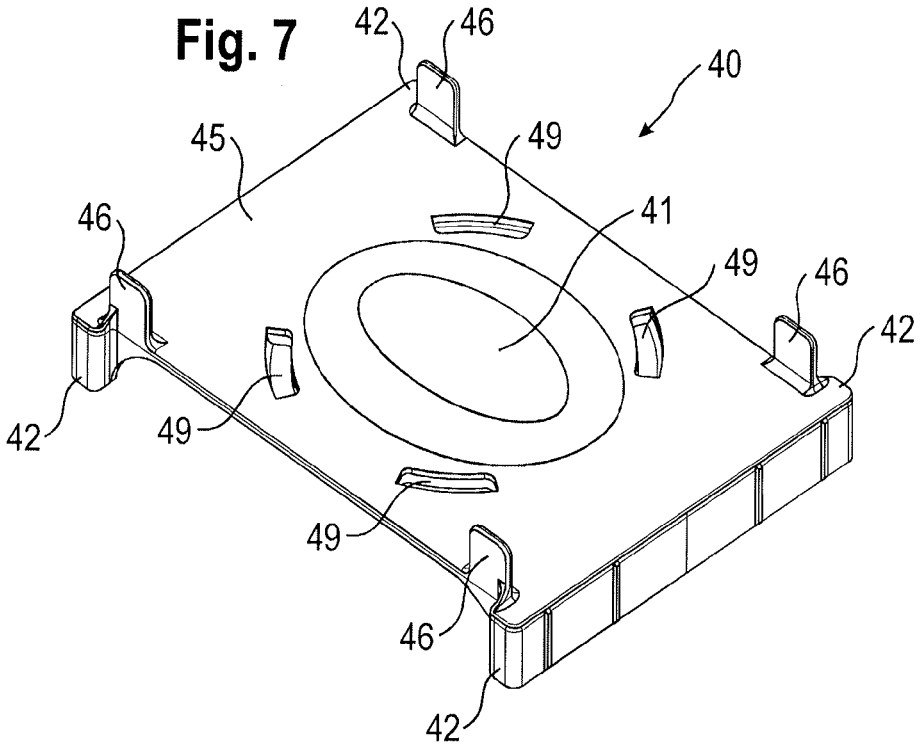

FIG. 7 shows a perspective view of a platform that is to be movably accommodated by the interior area defined by the product housing on top of which the stack of products held by the product reservoir is to be placed. Projections are provided for riding in and being guided by channels defined in the sidewall. The platform further includes a bulbous central area that projects into the bottom of the stack of products. Yet further, the platform includes upstanding alignment tabs for aligning the stack of products on the platform.

Figure 8:
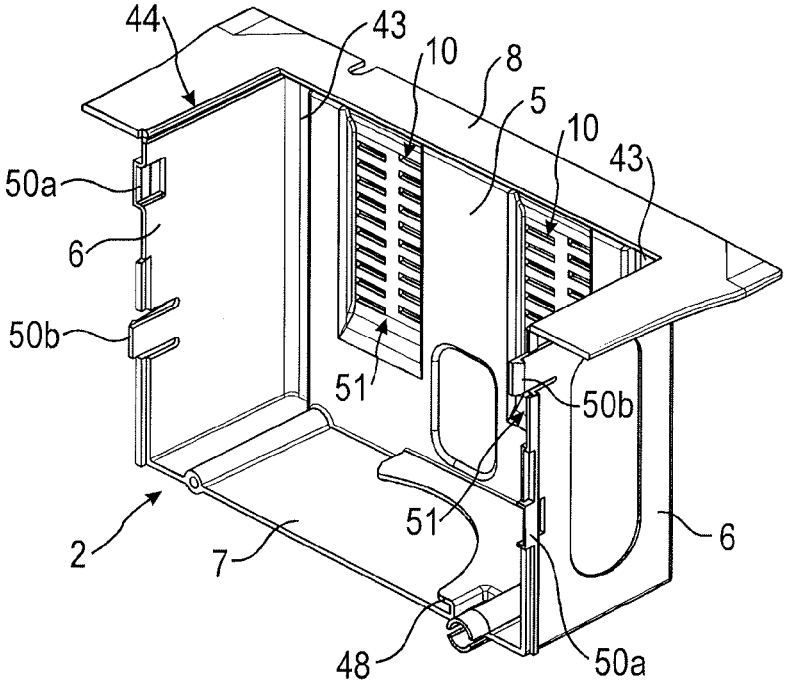

FIG. 8 shows a manner of making a product housing of a dispenser in which two identical components each defining a respective half of the product housing are mateable with one another through tabs and recesses or the like to define the complete product housing. This figure also shows the channels within which the projections of the platform of FIG. 7 ride.

Figure 9:
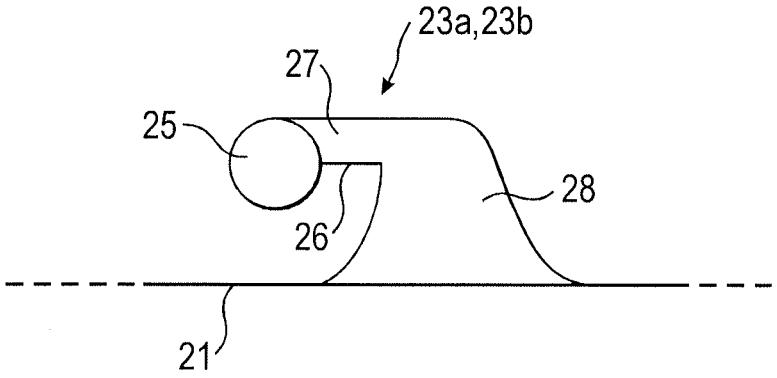

FIG. 9 discloses an overhang formed upstanding member about which a lid of the cover member rotates. The overhang form allows a part of the lid member to be moved under the overhang to engage against a stop surface of a base member to thereby cause a lifting force that tends to lift the cover member from the dispenser housing.

Figure 10:
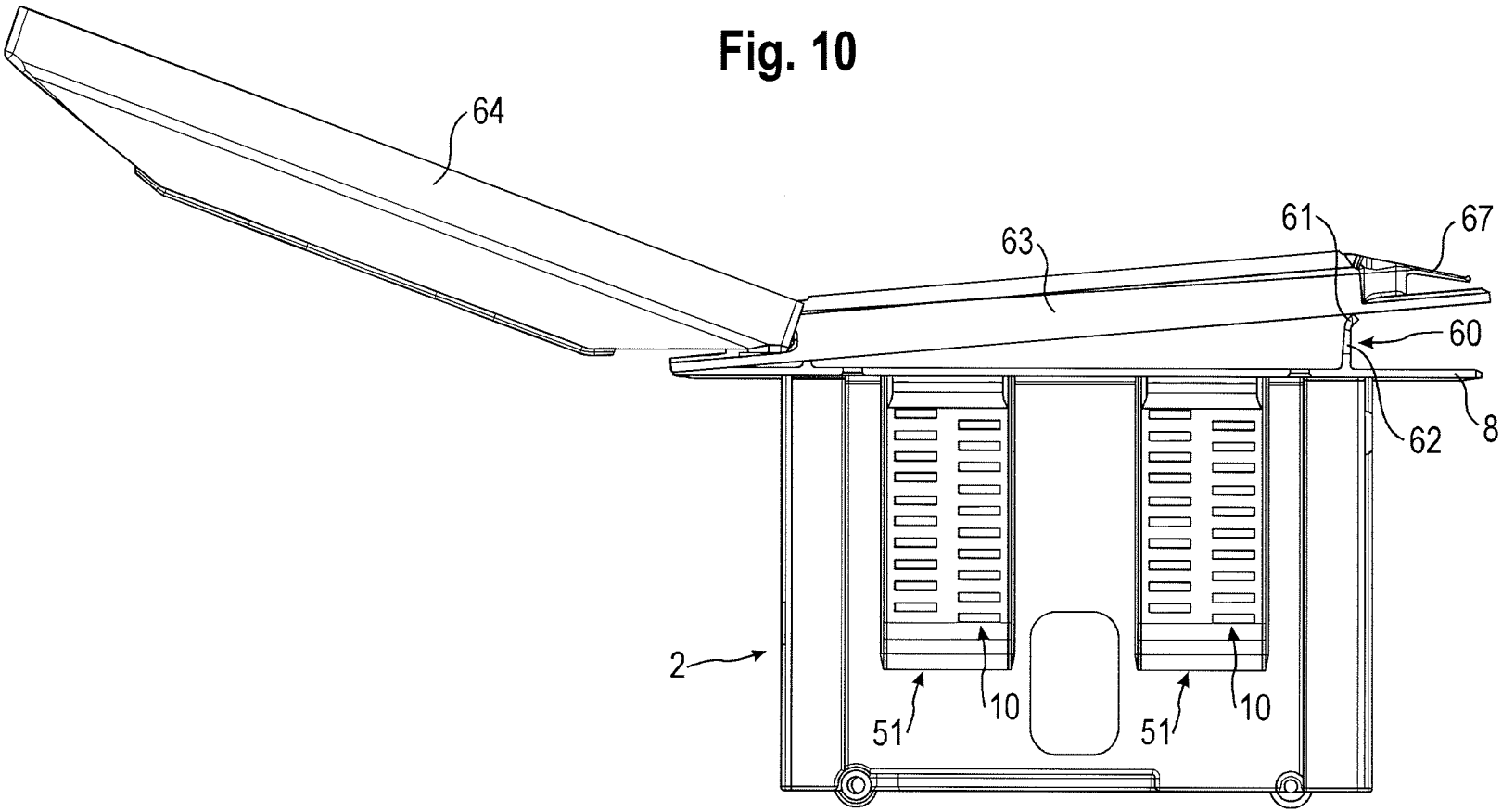

FIG. 10 shows a sheet product dispenser according to an embodiment. In this embodiment, the cover member, which includes a lid member and a support member, is mounted to a product housing of the dispenser by an alternative mounting mechanism. Instead of the use of tabs downwardly depending from the support member, the product housing includes upstanding tabs that have an angled ledge at a free end of the upstanding tabs that pass through slots in the support member and engage against a surface of the support member once the angled ledges have passed through the slots. This provides for secure engagement of the support member to the product housing, while a resilient deflection of the upstanding tabs allows for the support member to break away from the product housing to ensure the integrity of the hinge mechanism between the lid member and the support member.

Figure 11:
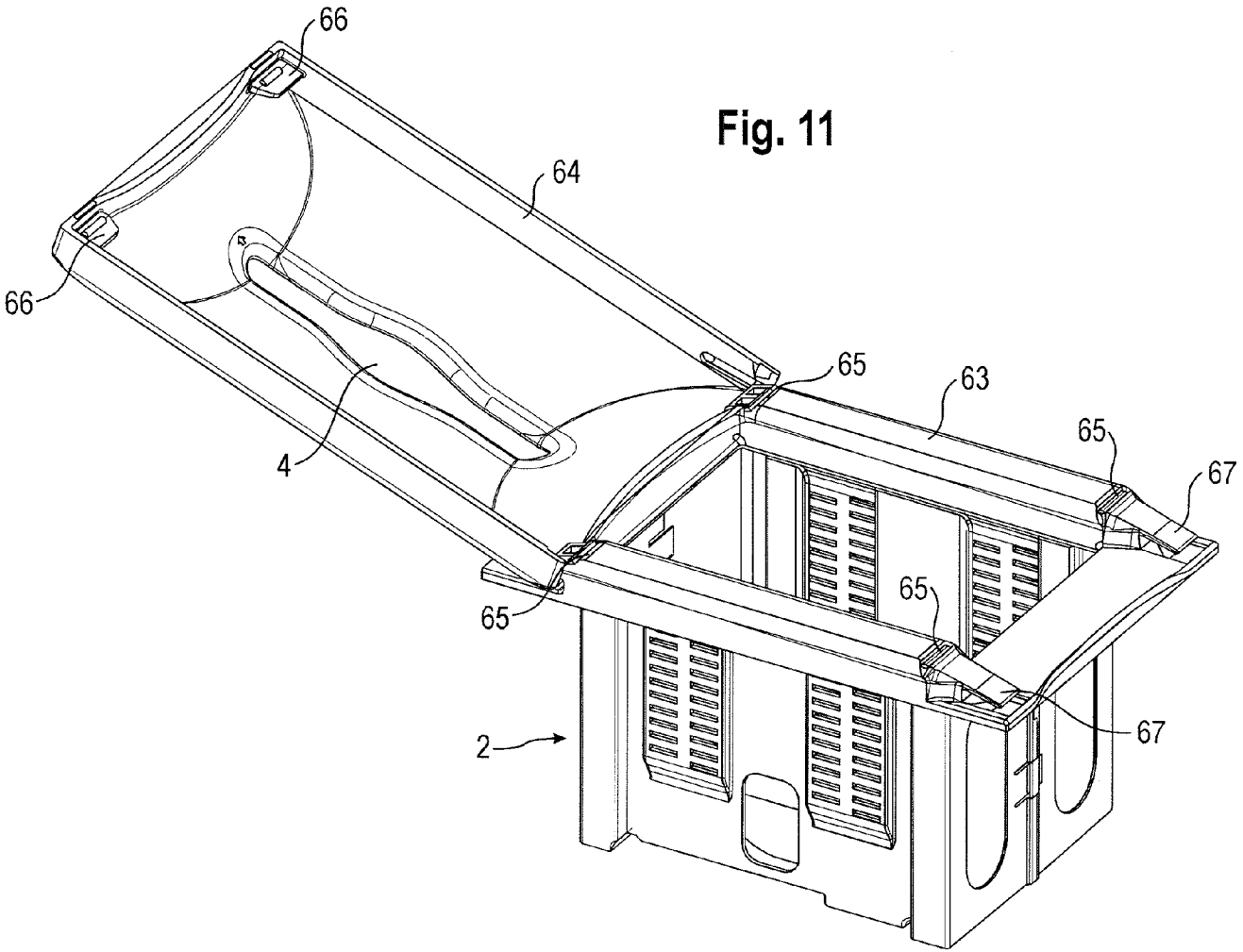

FIG. 11 shows a perspective view of the sheet product dispenser in an open condition in which can be seen an alternative latching mechanism for closing the lid member to the support member as compared to the second pin and groove mechanism shown in FIGS. 2 to 9. The alternative latch mechanism for holding the lid member to the support member includes cooperating catch members, with a pair of catch members on an underside of the lid member and a pair of catch member disposed on the support member that catch with one another when the lid member is moved from a shifted position relative to the support member to a centralized position.

Figure 12:
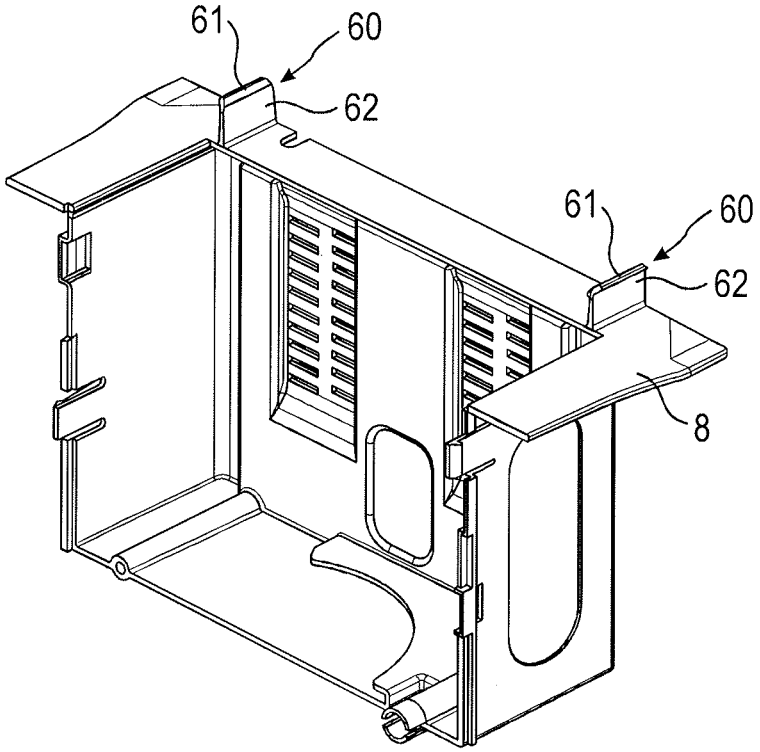

FIG. 12 shows a view of the product housing in which the tabs upstanding from a flange of the product housing can be seen. These tabs are for passing through slots in the cover member to engage against a surface of the cover member for holding the cover member to the product housing. FIG. 12 also shows that the product housing is made by molding identical halves that mate with one another to form the complete product housing. This feature of the invention will be described primarily with respect to FIG. 8 in the following.

DETAILED DESCRIPTION OF PREFERRED EMBODIMENTS

FIG. 1 shows a dispenser 1 including a product housing 2 and a cover member 3. The dispenser 1 is of the type to be inserted through a cut-out in a counter top or other such wall member so that most of the product housing 2 is positioned behind the counter top and so that the cover member 3 is positioned on top of the counter top.

The cover member 3 is openable relative to the product housing 2 so that the product housing can be replenished with a stack of products when the product housing 2 is empty or depleted from a full condition.

Further features of the dispenser 1 of FIG. 1 can be seen in the dispenser 1 of FIG. 3. The cover member 3 includes a dispensing opening through a central region of the cover member 3 through which products held in the product housing 2 can be dispensed when the cover member 3 is in the closed position shown in FIG. 1. The dispenser 1 of FIG. 3 is shown in an open position for refilling the product housing 2. The dispensing opening 4 is provided in the form of an elongate slot.

The product housing 2 includes first, second, third and fourth sidewalls 5, 6 defining an interior area in which a stack of products is to be arranged so as to provide a product reservoir. The sidewalls define a sleeve that is open at a top end for receiving a stack of products through the open entrance to the sleeve when the cover member 3 is in an open position during a refilling procedure. The sleeve is closed at a bottom end by a base wall 7 shown in FIG. 1. The product housing 2 includes a flange 8 extending from the sidewalls 5, 6 at a top end of the product housing 2 for seating against a top major surface of a counter top with the sidewalls 5, 6 of the product housing 2 extending through the thickness of the counter top. The counter top or other such wall member comprises opposed major surfaces that are substantially planar and parallel with one another. The front major surface of the counter top with respect to a process of inserting the product housing 2 through a cut-out in the counter top will be referred to as a top surface in places in the present description, while the opposed major surface will be referred to as a bottom or underside major surface of the counter top. It should be understood, however, that while the present disclosed embodiments are useable with a counter top or other such wall member that is horizontally aligned, it is also envisaged that the dispenser 1 could be applied to a wall member that is vertically or other wise aligned.

With reference to FIGS. 5 and 6, there is shown a manner of mounting the dispenser 1 to a counter top 9. The dispenser 1 is inserted through a cutout in the counter top 9 so that the base wall 7 passes through the cutout first and the product housing 2 continues to pass through the cutout until the flange 8 comes into contact with a top surface of the counter top 9 at which point the product housing 2 cannot pass further through the counter top 9 because the flange 8 has a larger profile than the cutout in the counter top 9. In the prior art, as described in the background section above, the flange 8 would then be screwed or otherwise affixed to the counter top 9 in a way that damages the counter top 9. Further, in the prior art, the cover member would be hingedly connected to the product housing during insertion. The present disclosed embodiments differ from the prior art in at least one respect by using pegs 13 that engage against an underside of the counter top 9 to secure the dispenser to the counter top 9 in a damage free manner, as will be detailed more fully in the following.

Referring in particular to FIG. 2, there is shown a product housing 2 in which mounting slots 10 are included in a side 5. The mounting slots 10 are provided in two opposed regions towards respective corners where the sidewall 5 meets the sidewalls 6. The opposed regions of mounting slots 10 are each provided in first and second columns 11, 12. The slots 10 in the first column 11 are offset from the slots 10 in the second column 12 in a longitudinal direction (which can also be considered a direction of stacking of the product in the product housing 2 or a bottom to top direction or a dispensing direction). Put another way, the flange 8 or the entrance to the interior area defined by the sidewalls 5, 6 of the product housing subsist in an X and Y direction, while the longitudinal direction of the product housing is in the Z direction, which is the largest dimension of the product housing 2. The mounting slots 10 in the first column 11 are offset from the mounting slots 10 in the second column 12 in the Z direction. The mounting slots 10 in the first column 11 are positioned halfway between the mounting slots 10 in the second column 12.

The mounting slots 10 provide a position through which a peg (described below with reference to FIG. 4) can be inserted in order to secure the product housing 2 to a counter top 9 in a direction opposed to the insertion direction through the cutout in the counter top 9, i.e. in a product dispensing direction through the dispensing opening 4.

A peg 13 for inserting through the mounting slots 10 is shown in FIG. 4. The peg 13 includes first and second legs 14, 15 that are connected by a web portion 16 and which define between them a space 17 so that the peg 13 is generally formed in a U-shape. The peg 13 can be described as having a distal end at the bight end or the web portion 16 and a proximal end at the free ends of the legs 14, 15. The legs 14, 15 can be brought together so as to reduce or fully close the space 17 between the legs 14, 15. This can be done by a user squeezing together the proximal end of the legs 14, 15 by making use of graspable flange portions 18, 19 so as to reduce the space 17 between the legs 14,15. The peg 13 has a resilient nature so that when the flange portions 18, 19 are let go by the user, the legs 14, spring back apart to reopen the space 17 between them. The peg 13 further includes a notch 20 at a proximal end of the peg 13 that is sized to fittingly receive the thickness of the sidewall 5 defining the mounting slots 10. The peg 13 tapers so as to define a reduced profile from a proximal end to the distal end in a width direction, which is a direction in which the first and second legs 14, 15 are able to be moved together so as to reduce the space between them. The thickness of the peg 13 is sized so as to be smaller than a thickness of the mounting slots 10 in the Z direction so that the peg is fittingly received therein. The width of the peg 13 at the notch 20 is sized to be fittingly received in the mounting slot 10 in a length direction of the mounting slots 10.

With reference to FIGS. 5 and 6, it will be described how the product housing 2 is inserted into a cutout and secured to the counter top 9 using the mounting slots 10 and pegs 13 of an embodiment. The product housing is inserted through the cutout in the counter top 9 in the Z direction until the flange 8 sits flat with a top planar surface of the counter top 9. The product housing 2 so inserted presents an entrance opening to an interior area defined by the sidewalls 5, 6 of the product housing 2 when viewed from above the counter top 9, wherein the entrance opening is surrounded by the frame-like flange 8. A user is able to insert a peg 13 held in the user's hand by inserting the peg 13 and the hand through the entrance opening and into the interior area and pushing the peg 13 through the first mounting slot 10 in the Z-direction through which it can be seen that the counter top is not blocking the projection of the peg 13 through the mounting slot 10. By taking the first mounting slot 10 or the mounting slot 10 that is closest to the bottom surface of the counter top 9, the peg 13 will be positioned flush with or as close as possible to flush with the bottom surface of the counter top 9 to reduce any possibility of movement of the dispenser in the counter top in the Z direction. In this way, the product housing 2 is tightly secured to the counter top 9 in the Z direction. The presence of the first and second columns 11, 12 of mounting slots 10 that are offset from one another provides a greater resolution for fitting the counter top 9 than would otherwise be provided if there was just one column of mounting slots 10.

The peg 13 is pushed through the mounting slot by a user pushing against the proximal flange 19 with the reduced width distal end 16 being inserted through the mounting slot 10. As the peg 13 moves through the sidewall 6 of the product housing 2, the resilient legs 14, 15 are squeezed toward one another as a result of the width of the peg 13 being greater than a length of the mounting slot 10 in the rest state of the peg 13. Once the mounting peg 13 is inserted far enough through the mounting slot 10, the notch 20 aligns with a part of the sidewall 6 defining the mounting slot 10 so that the resilient legs 14, 15 can resiliently move apart, whereby opposed sides of the notch 20 engage opposed sides of the sidewall 6 in a thickness direction of the sidewall 6 around the mounting slot 10. In this position, the peg 13 is secured to the sidewall 6 and projects from the sidewall 6 through the mounting slot 10 a suitable distance so as to securely engage an underside of the counter top 9. As shown in FIG. 6, the mounting peg 13 projects from an outside of the sidewall 6 by a distance that is substantially the same as the distance that the flange 8 projects from the outside of the sidewall 6.

The above process is repeated so that a respective mounting peg 13 is inserted through one of the mounting slots 10 in each of the four corner regions of mounting slots 10. In this way, the product housing 2 is secured between the flange 8 and a respective mounting peg 13 at four locations generally corresponding to corner portions of the sidewalls 5, 6 of the product housing 2. The flange 8 of the product housing 2 serves to secure the product housing 2 in the −Z direction and the pegs 13 serve to secure the product housing 2 in the +Z direction relative to the counter top 9.

Referring back to FIGS. 2 and 3, the frame member 21 forms a support part of the cover member 3 to which a lid member 22 is mounted via a hinge 23. Thus, the cover member 3 is openable by the lid member 22 rotating about the hinge 23 between an open position and a closed position. The open position is shown in FIGS. 2 and 3 and the closed position is shown in FIG. 1. The dispensing opening 4 is provided in the lid member 22. The lid member 22 is provided as a convex structure forming a peripheral lip 24 so as to define an interior cavity between the frame member 21 and the lid member 22 when the cover member 3 is in the closed position, whereby the peripheral lip 24 of the lid member 22 rests on the frame member 21. The dispensing opening 4 is provided at an apex area of the convex structure of the lid member 22.

A first hinge part 23*a* engages one side of the peripheral lip 24 of the lid member 22 at a corner portion and a second hinge part 23*b* engages the opposed side of the peripheral lip 24 of the lid member 22 on an inner surface. The lid member 22 rotates about the first and second hinge parts 23*a*, 23*b* between the open and closed positions of the cover member 3. The first hinge part 23*a* is provided by a pivot pin 25 (FIG. 9) disposed on the frame member 21 that extends into a pivot recess of the lid member 22. Likewise, the second hinge part 23*b* is provided by a pivot pin 25 that extends into a pivot recess of the lid member 22.

A more detailed view of the first and second hinge parts 23*a*, 23*b* can be seen in FIG. 9. The pivot pin 25 is provided at an end of an overhang area 27 of the hinge parts 23*a*, 23*b* so as to be suspended relative to a plane defined by the frame member 21. The overhang part 27 is connected to a base part 28 that is secured to an upper surface of the frame member 21. The pivot pin 25 extends outwardly as compared to an interior area defined within the frame member 21 so as to be able to engage a corresponding pivot recess defined on an interior surface of the peripheral lip 24 of the lid member 22. The overhang part 27 of the first and second hinge parts 23*a*, 23*b* provide a stop surface 26 against which an edge of the peripheral lip 24 comes into contact when the lid member 22 is in the open position. The stop surface 26 is generally parallel to the plane defined by the frame member 21.

Depending from an underside of the frame member 21 is a plurality of engagement tabs 29 that each include on a bottom end a projection 31 for extending into a correspondingly located slot 30 provided in a side wall 6 of the product housing 2 so that the frame member 21 can be mounted to the product housing 2 through the slot 30 of the housing 2 and the projections 31 of the engagement tabs 29. The engagement tabs 29 are resiliently disposed with respect to the frame member 21 so that the engagement tabs 29 resiliently snap fit into the corresponding slots 30 in the sidewall 6 to ease mounting of the cover member 3 to the product housing 2. The engagement tabs 29 are distributed about the frame member 21. In the embodiment shown in FIG. 3, there is provided eight engagement tabs 29 for engaging with eight correspondingly located slots 30 in the product housing.

The engagement tabs 29 can be disengaged from the slots 30 so that the cover member 3 can be removed from the product housing 2 by pulling in a direction that tends to lift the frame member 21 from the product housing 2 so as to resiliently deflect the engagement members 29 interiorly with respect to the frame member 21 to disengage the projections 31 of the engagement members 29 from the slots 30. Thus, the projections 31 may include slightly sloped surfaces for engaging an upper wall of the slot 30, rather than a more perpendicular ledge to ease disengagement of the engagement tabs 29 from the corresponding slots 30 so that an appropriate removal force for the cover member 3 with respect to the product housing 2 is achieved. Further factors in determining the force necessary to remove the cover member 3 with respect to the product housing 2 are the flexibility of the engagement tabs 29 with respect to deflecting inwardly to come out of engagement with the slots 30 and also the number of engagement tabs 29 and corresponding slots 30 provided for engaging the cover member 3 and the product housing 2.

In use, the lid member 22 is rotatable about the hinge 23 from a closed position in which the peripheral lip 24 of the lid member 22 sits substantially flush on the frame member 21 to an open position in which an opening defined by the frame member 21 is exposed for refilling the product housing 2. The first and second pivot pins 25 are disposed in the first and second recesses at one end of the lid member 22 to provide a rotation axis about which the lid member 22 rotates from the closed position to the open position. In the open position, an edge of the peripheral lip 24 of the lid member 22 engages the stop surface 26 of the first and second hinge parts 23*a*, 23*b* so that the lid member 22 cannot be further rotated in the opening direction about the hinge 23. In the stop position, any further attempt at rotating the lid member 22 in the opening direction will be resisted until the opening force is great enough that the edge of the peripheral lip 24 of the lid member 22 acts against the stop surface 26 such that at least some of the engagement members 29 of the frame member 21 are disengaged from the mounting slots 30 of the product housing 2. Importantly, the parts are constructed so that at least some of the engagement tabs 29 disengage from slots 30, and preferably all of them do, before the integrity of the hinge (provided by hinge part 23*a*, 23*b* and pivot pins 25) is compromised. Usually, the engagement tabs 29 closest to the hinge 23 pop out of the slots 30. When the lid member 22 is in the open position and the edge of the peripheral lip 24 is baring against the stop surface 26, a part of the lid member 22 may be positioned against the counter top or other such wall member so that a lever point assisting in lifting the cover member 3 from the product housing 2 by way of disengagement of the engagement tabs 29 from the mounting slots 30. It may be that only some of the tab members 29 have to disengage from the product housing 2 in order to protect the hinge 23 from breakage due to excessive opening force.

To mount the cover member 3 to the product housing 2, the frame member 21 is aligned with the flange 8 so that they overlap with one another. The frame member 21 is then pushed down, which will cause the engagement tabs 29 to resiliently deform inwardly until the projections 31 are positioned so as to snap fit into engagement with the mounting slot 30. This operation can be done with the lid member 22 in the open position or the closed position. It may be advantageous to mount the cover member 3 to the product housing 2 since then the engagement members 29 can be visibly aligned with the mounting slots 30. However, it is believed to be potentially easier to perform this mounting process with the cover member 3 in the locked and closed position since this offers a large surface area to push on (the external roof offered by the cover member 3) for doing the mounting process and it is believed that the design of the cover member 3 makes alignment of the tabs 29 and the slots 30 intuitive.

With the lid member 22 in the open position, the product housing 2 can be at least partly filled or refilled with a stack of dispensable products by passing the stack through an entrance opening into the product housing 2 so that the stack substantially fits with the interior area defined by the side walls 5, 6. The stack of products may be sheet products for wiping, particularly interfolded sheet products, and more particularly interfolded napkins.

The engagement tabs 29 and the mounting slots 30 are symmetrically positioned so that the frame member can be mounted in the orientation shown in FIGS. 2 and 3 or in an opposite sense, whereby the lid member 22 is openable anticlockwise with respect to the product housing 2 in one configuration or it can be mounted in the opposite sense so that the lid member 22 rotates in a clockwise direction about the hinge 23 during opening. That is, with respect to the wall 5, the hinge 23 is located at a left end of the wall 5, while in another mounting possibility, the cover member 3 could be oriented in an opposite sense to that shown in FIGS. 2 and 3 so that the hinge 23 is located at a right end of the side wall 5 of the product housing 2. This feature enables the cover member 3 to have a degree of mounting flexibility so that if a feature at the mounting location gets in the way of the opening of the cover member 3, then the cover member 3 can be mounted so that it opens in the opposite direction to thereby avoid the permanent feature at the mounting location. This feature of the dispenser 1 is particularly useful when a new permanent piece is added at the mounting location, since the cover member 3 can simply be reversed so that it opens in the opposite direction, to thereby accommodate the newly added piece at the dispenser location.

In another useful feature, there is provided opposed first grooves 32 at one end of the peripheral lip 24 on an inside surface of the peripheral lip 24. The first grooves 32 include pivot recesses at one end of the first grooves for receiving the pivot pins 25 to provide the hinge 23 as described above. The first grooves 32 further include second, locking recesses 33 at the other end of the first grooves 32 for holding the lid member 22 fast against the frame member 21 to not allow pivoting to the open configuration.

The pivot pins 25 of the first and second hinge parts 23*a*, 23*b* are respectively positioned in the opposed pivot recesses so that the lid member 22 can be rotated between the open and closed positions. Further, the pivot pins 25 can ride along the first grooves 32 so that the pivot pins 25 can be situated in the second recesses at the other end of the first grooves 32 in which a locked and closed position of the lid member 2 is provided. The first grooves 32 are diagonally oriented in such a way that a greater space in the Z direction is provided between the second recesses 32 and the frame member 21 than is provided between the pivot recesses and the frame member 21. In this way, when the lid member 22 is moved so that the pivot pins 25 are guided from the pivot recesses to the second recesses 33, the lid member 22 is moved into closer engagement with the frame member 21. More specifically, the lid member 22 is, as a result of the diagonal shape of the first grooves 32, moved further away from the frame member 21 when the lid member 22 is positioned so that the pivot pins 25 are engaged with the pivot recesses, as compared to when the pivot pins 25 are engaged with the second recesses 33, so that an increased amount of space is provided between the frame member 21 and the peripheral lip 24 of the lid member 22 at the hinge end in order to accommodate rotation of the lid member 22 from the closed position to the open position.

The first and second hinge parts 23*a*, 23*b* of the hinge 23 are provided at one end of the frame member 21. At an opposed end of the frame member 21, there is provided correspondingly shaped parts, which we will refer to in the following as latch parts 34*a*, 34*b*. The frame member 21 can be considered to have first and second opposed ends, wherein the first end is an end 21 at which the hinge 23 of the lid member 22 is provided and the second end is opposite to the first end with respect to rotation of the lid member 22 about the hinge 23. The pivot pins 25 of first and second hinge parts 23*a*, 23*b* face the first end of the frame member 21 as compared to the base part 28, whereas the first and second latch parts 34*a*, 34*b* are oppositely oriented so that the outwardly pointing pins 35 face toward the second end as compared to a base portion to which the pins are secured. The pins 35 are located so as to cooperate with second latch grooves 36 provided at an opposite end to the grooves 32 of the lid member 22. The latch grooves 36 are defined in an interior surface of the peripheral lip 34 on opposed sides of the peripheral lip 34 at the end of the lid member 22 opposed to the hinge member 23 of the cover member 3.

The grooves 36 have an entrance/exit opening 37 at one end that is open at an edge of the peripheral lip 34 in order to allow the latch pins 35 to enter and exit the grooves 36 as the lid member is respectively opened and closed. At the opposite end of the latch grooves 36 to the entrance/exit opening is a latch recess 38 for defining a closed and locked position of the lid member 22 relative to the frame member 21 since the cooperation between the latch pins 35 and the latch recesses 38 is to block an opening motion of the lid member 22.

An opening and closing operation of the cover member 3 will now be described. We take as a starting point for this description, the open position shown in FIGS. 2 and 3. In this open position, the pivot pins 25 are located in respective pivot recesses at a hinge end of the lid member 22, respectively on opposed sides of the peripheral lip 24. The cooperation between the pivot pins 25 and the pivot recesses is such that the lid member 22 can rotate from the open position shown to the closed position. As the end of the lid member 22 approaches the second end of the frame member 21, the outwardly pointing pins 35 of the first and second latch parts 34*a*, 34*b* pass through the entrance/exit openings 37 of the latch grooves 36. In this position of the lid member 22, the lid member 22 is substantially closed in the Z direction so as to close the interior area defined by the product housing 2 with the cover member 3, but the lid member 22 is offset towards the second end of the frame member 21 so that the dispensing opening 4 and the lid member 22 are not properly centrally positioned with respect to the entrance opening into the product housing 2. In order to close and lock the lid member 22, the lid member 22 is pushed toward the first end of the frame member 21, which causes the pivot pins 23*a*, 23*b* to ride along the first grooves 32 so as to exit the pivot recesses and enter the second recesses 33 while simultaneously, the latch pins 35 ride along the latch grooves 36 so as to enter the latch recesses 38. In this position of the lid member 22, the lid member 22 is properly closed and locked and properly positioned over the product housing 2 so that the dispensing opening 4 is centrally positioned with respect to the entrance opening into the product housing 2. Further movement of the lid member 22 in the direction of the first end of the frame member 21 is blocked since the pivot recesses 33 and the latch recesses 38 define an end of the respective grooves 32, 36. Any attempt to open the lid member 22 in the locked and closed position of the lid member 22 is resisted since the recesses 33, 38 are close to the edge of the peripheral lip 24, thereby providing a blocking surface to any opening movement of the lid member 22. The lid member 22 is also not able to pivot about the pivot pins 25 when they are in the second recesses 33 since rotation about the pivot pins 25 in this position causes the lid member 22 to be blocked by the flange 8.

Starting from the closed and locked position of the lid member 22 just described, the lid member 22 can be opened by shifting the lid member 22 toward the second end of the frame member 21. This moves the pivot pins 25 from being situated in the second recesses 33 along the guide groves 32 until the pivot pins 25 are situated in the pivot recesses, while at the same time the latch pins 35 are moved from being situated in the latch recesses 38, along the latch grooves 36 to a position at the end of the latch grooves 36 aligned with the entrance/exit openings 37. In this position, the lid member 22 can be rotated about the hinge 23 provided by the pins 25 being situated in the pivot recesses and the latch pins 35 exit from the grooves 36 at the entrance/exit openings 37. During rotation of the lid member 22 to an open state, an edge of the peripheral lip 24 at the hinge end of the lid member 22 rotates in the space between the frame member 21 and the suspended pivot pins 25 until it comes into contact with the stop surfaces 26 of the first and second hinge parts 23*a*, 23*b* to define a fully opened lid member 22, which is thus in the open position.

The latch grooves 36 are diagonally oriented in the same sense as the first grooves 32 at the hinge end of the lid member 22 so as to define a greater space between the latch recesses 38 and an edge of the peripheral lip 24 than the corresponding space at the start of the latch grooves 36 at the entrance/exit opening 37 end. When the lid member 22 is shifted so that the pivot pins 25 are moved along the first grooves 32 from the pivot recesses to the second recesses 33 and the latch pins 36 are moved from an entrance/exit opening 37 end of the grooves 36 to the latch recesses 38, the lid member is moved toward the frame member 21 as a result of the diagonal direction of the grooves 32, 36 and the cam like interaction of the pins 25, 35 with the grooves 32, 36 so that the edge of the peripheral lip 24 is brought into or substantially into flush engagement with the frame member 21. When the lid member 22 is moved relative to the frame member 21 so that the pivot pins 25 move along the first grooves 32 from the second recesses 33 to the pivot recesses and the latch pins 35 move from the latch recesses 38 along the latch grooves 36 to the latch exit/entrance openings 37, the lid member 22 is raised relative to the frame member 21 as a result of the cam shape of the grooves 32, 36. This raising of the lid member 22 as it moves from the locked position to the position in which the lid member 22 can be opened accommodates movement of the peripheral lip 24 in a space defined between the flange member 21 and the suspended pivot pins 25 so that the peripheral lip 24 can rotate into engagement with the stop surfaces 26 of the first and second hinge parts 23*a*, 23*b* by passing underneath the pivot pins 25 to the stop surfaces 26.

FIG. 7 shows a platform 40 that is to be mounted in the interior area defined by the product housing 2 and serves to support a bottom of a stack of dispensable products. The platform 40 is movable in the Z direction in the product housing 2 so as to accommodate different stack sizes. A spring member (not shown) is mounted between an underside of a platform 40 and the base 7 of the product housing 2 so that the platform 40 is biased toward the dispensing opening 4 to ensure that the stack of dispensable products is always disposed adjacent to the dispensing opening 4.

The platform 40 includes guide protections 42 at each corner of the platform 40 that ride in respective guide channels 43 in each corner of the interior area of the product housing 2 (FIG. 8). The guide channels 43 extend in the Z-direction so that the platform 40 can be guided from a position adjacent to the base 7 of product housing 2 to a position adjacent an entrance opening 44 into the interior area defined by the product housing 2, which entrance opening 44 lies in the plane defined by the flange 8 of the product housing 2. The platform 40 includes a bulbous portion sticking up from a planar upper surface 45 of the platform.

Also sticking up from the generally planar upper surface 45 of the platform 40 are a plurality of alignment tabs 46 that define planar surfaces facing toward the interior of the platform 40 that extend upwardly so as to be generally perpendicular to the plane defined by the upper surface 45. The alignment tabs 46 are oriented so that the planar surface defined by the alignment tabs 46 extends parallel to a side of a stack disposed on the upper surface 45 of the platform 40. These alignment tabs 46 serve to position the stack centrally on the platform 40.

To load a stack of sheet products into the dispenser 2, the cover member is opened using a shift and rotate process, as described above, to reveal the entrance opening 44 to the product housing 2. The stack of products are then aligned with the cross-sectional shape of the interior area of the product housing 2 with a leading end of the stack facing upwardly and a trailing end of the stack facing toward a base 7 of the product housing 2. Assuming that the product housing 2 has been entirely depleted, the bottom or trailing end of the stack is positioned in engagement with the upper surface 45 of the platform 40 and with the bulbous central portion 41 positioned centrally on the bottom surface of the stack. The alignment tabs 46 assure that the stack remains centrally positioned in that they are in engagement with the sides of the stack if the sides of the stack are shifted away from a central position on the platform 40. In order to close the cover member 3, the stack is pushed down by a hand of the user to push the platform 40 toward the base 7 of the product housing 2 against the bias of the spring until the whole of the stack is contained in the dispenser 1. The cover member 3 is then moved into the closed and locked position. The bulbous central portion 41 of the platform 40 tends to push a central area of the stack upwardly toward the dispensing opening 4, which becomes particularly useful as the stack becomes depleted since the bulbous central portion 41 is able to enter the space between the entrance opening 44 of the product housing 2 and the cavity defined by the concave lid member 22 in the Z-direction.

FIG. 8 shows one half of the product housing 2, which can be combined with an identically formed half of the product housing 2 in order to complete the product housing 2. This feature of the present disclosure allows the product housing 2 to be manufactured in a convenient manner since the same mold can be used for forming both halves of the product housing 2. The product housing 2 is thus divided into two identical parts respectively including half of the flange 8, a first sidewall 5 including first and second groups of mounting slots 10, half of the base wall 7, and half of second and third sidewalls 6. The second and third sidewalls 6 include respective components of snap fit fasteners 50*a*, 50*b*, positioned so that when an identically formed part is positioned against the first half of the product housing 2, a first component of the snap fit fastener 50*a* of the first half of the product housing 2 engages with a complementary second component 50*b* of the snap fit fasteners and vice versa to secure the two halves of the product housing 2 together.

FIG. 8 shows a further advantageous feature that can be applied to the previously disclosed embodiments. In particular, the first group of mounting slots 10 and the second group of mounting slots 10 are provided in respective recessed sections 51 of the wall 5 so that the outside of the wall 5 bulges outwardly where the recessed sections 51 are positioned on the inside. The general body of the inside of the sidewall 5 and the outside of the sidewall 5 is otherwise generally planar. The recessed sections 51 provide a space for accommodation of the proximal end of the pegs 13, and particularly all portions of the pegs 13 that are proximal of the notch 20. Thus, the recessed sections 51 provide a space between the sides of the stack of dispensable products and the sides of the platform 40 to accommodate the user graspable flanges 18, 19 of the peg 13 without the proximal end of the peg 13 coming into contact with the sides of the stack of products or the sides of the platform 40 when the peg 13 is positioned and engaged with a mounting slot 10 in the recessed section 51. That is, the recessed section 51 provides a space so that any proximal portion of the peg 13 protruding interiorly of the mounting slot 10 does not interfere with movement of the platform or the stack toward the dispensing opening 4. The recessed section 51 further allows the notch 20 of the peg 13 to be positioned slightly spaced from the user graspable flanges 18, 19 to make it easier for the user to grasp the flanges 18, 19 when removing the peg 13 from a mounting slot 10.

FIGS. 7 and 8 show features of the platform 40 and the product housing 2 that enable a spring to be held in axial and circumferential position that also allow easy assembly of the spring to these parts 2, 40 of the dispenser 1. Referring to FIG. 7, the platform 40 has coil receptacle parts 49 to hold at least one coil of the spring axially and circumferentially to an underside of the platform 40. Likewise, the base 7 of the product housing 2 includes coil receptacle parts 48 for axially and circumferentially holding at least one coil of the spring to the base 7 of the product housing 2. Thus, a top one, two or more coils of the spring are held in the platform coil receptacle parts 49 and a bottom one, two or more of the coils of the spring are held in the base coil receptacle parts 48. Advantageously, the receptacle parts 48, 49 of the platform 40, the base 7 or both are circumferentially spaced so that the coils of the spring may be passed into the respective coil receptacle 48, 49 in an easy to assembly manner.

FIGS. 10 to 12 show an embodiment that differs from the above described embodiment with reference to FIGS. 1 to 6 in the form of a mechanism for holding the cover member to the product housing, while also allowing the cover member to break away from the product housing when the opening force exerted on the cover member becomes too great. This embodiment further differs in the form of a latch mechanism for securing the lid member to the support member when the lid member is shifted from a position in which the lid member is openable relative to the support member to a centralized position in which the lid member is blocked from opening. There are, however, a majority of features in common to, or at least applicable to, both the dispenser of FIGS. 1 to 6 and the dispenser of FIGS. 10 to 12, as will be made clear below.

Referring to FIG. 10, there is shown a product housing 2 defining an interior area for housing a stack of sheet products, such as napkins. The product housing 2 will only be described for the present embodiment with respect to differences with the previously disclosed embodiment.

The product housing 2 is shown with columns of mounting slots 10 provided in a sidewall of the product housing 2, where first and second columns of mounting slots 10 are located in respective recessed regions 51 with respect to the interior area defined by the product housing 2. These recessed regions 51 are described above with respect to FIG. 8. The recessed regions 51 are not shown in the product housing 2 of FIGS. 1, 2 and 3, indicating that they are a particular feature and may be omitted so that the slots are provided through a continuously planar side wall of the product housing 2.

Continuing to refer to FIG. 10, the product housing 2 has a flange 8 as described previously for seating on an upper surface of a counter top or other wall member while the depending sidewall of the product housing 2 extends through a cutout in the counter top or wall member into a cavity in or behind the counter top or wall member. On the flange 8, there is provided a plurality (in the shown embodiments as can be seen with respect to FIG. 12 there is four), upstanding tabs 60, where upstanding is in a direction normal to the plane of the flange 8 and is to be understood as extending upwardly with respect to the downwardly extending sidewall of the product housing 2 defining the interior area for housing a stack of sheet products. The upstanding tabs 60 extend for the most part perpendicularly to the plane defined by the flange 8. A free or distal end of the upstanding tab 60 includes a relatively angled portion 61 (but not so angled as to be perpendicular) as compared to the straight portion 62 extending between the angled portion 61 and the flange 8 of the product housing 2.

The alternatively formed support member 63 remains frame shaped when viewed in plan, as shown in FIG. 11. The frame of the support member 63 defines an opening that is coextensive with an entrance opening into the interior area of the product housing 2, as in the previous embodiment. A lid member 64 is pivotably mounted to the support member 63 by a hinge mechanism at one end of the lid member 64. The hinge mechanism is similar to that previously described in that it includes a cammed pivot pin and groove mechanism, where the groove includes a pivot recess at one end and the pivot pin is able to ride along the groove to a depression at the other end defining a position of the lid member 64 in which the lid member 64 is blocked from pivoting between opened and closed positions. Further, the groove is angled as in the previous embodiment so that the lid member 64 is raised in a direction normal to the plane defined by the frame shape of the support member 63 relative to the support member 63 when the lid member 64 is positioned so that the pivot pins engage the pivot recesses of the grooves and is moved closer to the support member 63 when the pivot pins are at the other end of the groove. Thus, the pin and groove hinge mechanism between the support member 63 and the lid member 64 will not be described in further detail with respect to the present embodiment, and we rely on the previous discussion regarding these features. Note that the pivot pins of the support member 63 remain in an overhang type orientation as described above with respect to FIG. 9 so that a skirting of the lid member 64 depending from a general body of the lid member 64 is able to pass under the pivot pins when the lid member 64 is moved to the open position and engage against a stop surface positioned in the space defined by the overhang of the pivot pins to define a most open position of the cover member 63, 64.

The support member 63 includes a plurality of slots 65 through which the upstanding tabs 62 pass when the support member 63 is clipped onto the product housing 2 so that the frame of the support member 63 is aligned with the flange 8. In the clipped on position of the support member 63 with respect to the product housing 2, the angled free ends 61 of the upstanding tabs 60 engage against a top surface of the support member 63.

To mount the support member 63 to the product housing 2, the support member 63 is aligned so as to overlie the flange 8 and so that the upstanding tabs 60 of the product housing 2 align with the slots 65 of the support member 63. The user then pushes down on the support member 63, which causes the upstanding tabs 60 to deflect, by way of an interaction with an underside of the support member 63, so that the angled free ends 61 of the support member 63 are able to pass through the slots 65. Once the angled free ends 61 of the upstanding tabs 60 are through the slots 65, the upstanding tabs 60 resiliently reform so that the angled free ends 61 engage against an upper surface of the support member 63. This engagement holds the support member 63 against the product housing 2 in a clipped on position so that the support member 63 does not disengage from the product housing 2 during most uses.

Importantly, the resiliency of the upstanding tabs 60 and the angle of the free ends 61 are set so that when the lid member 64 is rotated to an open position and the user then applies an excessive opening force even when the lid member 64 is in its most open position (that is, the lid member 64 is stopped from opening any further by an interaction between the lid member 64 and a stop surface on the support member 63) the support member 63 will disengage from the product housing 2 by the upstanding tabs 60 deflecting to allow the angled free ends 61 to pass through the slots 65. The support member 63 thus pops off of the product housing 2 when the lid member 64 is in an open position and an excessive opening force is continued to be applied to the lid member 64. This protects the integrity of the hinge mechanism of the lid member 64 and the support member 63.

The lid member 64 includes first and second catch members 66 at an end of the lid member 64 opposed to the hinge end of the lid member 64 with respects to an opening operation about the hinge. The catch members 66 are provided on an underside of the lid member 64 with respect to the outside being outside of the dispenser. To mate with the catch members 66, the support member 63 includes cantilevered ramp members 67 that define a space under the cantilevered ramp members 67 through the cantilevered structure to accommodate the catch members 66. The cantilevered ramp members 67 ramps downwardly, i.e. in the closing direction of the lid member 64, to match the ramped shape of the lid member 64. This construction thus allows a latching mechanism for locking the lid member 64 closed with respect to the support member 63 to be provided without requiring a second groove and pin mechanism as in the embodiment discussed above with respect to FIGS. 2 and 3.

An opening, closing and locking operation of the cover member 63, 64 will be described. Starting from the open position shown in FIG. 11, the lid member 64 is closable about the hinge mechanism so that the catch members 66 move past the ends of the cantilevered ramp members 67 in the closing direction. This provides a closed position of the lid member 64, but not yet locked. In the closed position, an extended depth of the support member 63, as compared to the planar like frame member 21 of FIG. 2, means that a substantial depth of the skirting of the lid member 64 interfaces with a depth of the support member 63 to provide a nicely mating lid member 64 and support member 63. The extended depth feature for the support member 63 is applicable to the planar-like support member 21 of FIG. 2.

From the closed position, the lid member 64 can be shifted, so that the catch members 66 of the lid member 64 move into the space provided underneath the cantilevered ramp members 67 so that the catch members 66 and the cantilevered ramp members 67 act to block opening of the lid member 64 relative to the support member 63, to thereby define a locked position of the lid member 64. In shifting the lid member 64 along the plane defined by the frame-like support member 63, the lid member 64 moves from an offset position to a centralized position in which a central axis passing through a base of the product housing 2 and the interior area of the product housing 2 also passes through a central position of the dispensing opening 4 of the lid member 64 rather than an off-centre position. The lid member 64 is able to be shifted relative to the support member 63 from the offset position to the central position by the catch members 66 passing underneath the cantilevered ramp members 67 and by pivot pins of the hinge mechanisms of the lid member 64 riding along the grooves in the skirting of the lid member 64.

Alternative forms of the specific construction shown in the figures can be created, without departing from the general scope of the invention as defined by the claims.

In particular, it is considered that many aspects could be implemented without the presence of a lift off frame member 21, 63. Thus, the cover member 3, 63, 64 of FIGS. 2 3, 10, and 11 could be implemented as a lid member 64 that is mountable to a hinge mechanism and a latch mechanism that are mounted directly on the flange 8 of the product housing 2. In this way, the shift and rotate opening and closing mechanism described above could be implemented without the use of a lift off frame member 21, 63.

The embodiment of FIGS. 2 and 3 could further be modified in that the frame member 21 is not used, and instead the hinge parts 23*a*, 23*b* and the latch parts 34*a*, 34*b* are removably mounted directly to the flange 8 of the product housing 2. This is similar to the modification described in the foregoing paragraph, but the hinge parts 23*a*, 23*b* and 34*a*, 34*b* are removably mounted to the flange 8 of the product housing 2 so that the lift off feature previously described with respect to the frame member 21 can still be maintained.

Further, the lid member 22 could be provided with different grooves 32, 36 to those shown so that the grooves at one end of the lid member 22 include a pivot recess and the grooves at the other end of the lid member 22 also include a pivot recess. Further, the grooves at the one end of the lid member 22 could include an entrance/exit opening at an end of the groove opposed to the pivot recess, while the grooves at the other end of the lid member 22 can also include entrance/exit openings opposed to the pivot recesses. In this way, the lid member 22 could be shifted in one direction so that the hinge mechanism is at one end of the lid member or shifted in a second direction so that the hinge mechanism is at the opposite end of the lid member, to thereby enable opening of the lid member 22 with respect to the product housing 2 in opposite directions without having to include a frame member 22 that is mountable in opposed orientations.

In the embodiments shown in the figures, there is provided first, second, third and fourth groups of mounting slots 10, each including first and second columns of mounting slots 11, 12. This has been found to be an optimal number of groups and columns for securely mounting the product housing 2 to the counter top 9 or other such wall member. Nonetheless, other configurations are possible. We imagine that providing only a first group of mounting slots 10 would be workable in terms of the function of preventing the product housing 2 from jumping toward the user during dispensing through the dispensing opening 4. Similarly imaginable, is a construction whereby only first and second groups of mounting slots 10 are provided in diagonally opposed corner portions of the product housing 2. Further, while first and second columns 11, 12 are provided in the shown embodiment, only one column of mounting slots 10 could be provided, which would still allow different thicknesses of counter top 9 to be accommodated, but with a greater step between each counter top thickness that can be fittingly accommodated, as defined by the size of the steps between each mounting slot 10 in the Z direction. If even finer steps are required between adjacent mounting slots in the Z direction, a third column could be introduced with the first, second and third columns being offset from one another in the Z direction by ⅓ of the space between mounting slots 10 in each individual column. Also, in another variation, if the size of the counter top 9 is known or is standardized for particular customers, then the product housing 2 could be manufactured with just one mounting slot at each peg receiving location of the product housing 2.

In the shown embodiments, the flange 8 is a continuous frame-like member provided about the periphery of the product housing 2. Embodiments can be envisaged whereby the flange 8 is provided as a series of flange portions spaced from one another about the periphery of the product housing 2. Also, it can be envisaged that not only could pegs 13 projecting through mounting slots 10 be used for engaging a lower surface of the counter top 9 or other such wall member, but the flange 8 could be dispensed with and a second set of pegs and mounting slots could be provided for engaging a top surface of the counter top 9. In yet another alternative, the product housing 9 could be mounted from below the counter top 9, in which case a permanent flange could be provided for seating against the bottom of the counter top 9, while the peg and slot mounting construction described above could be used for seating against the top surface of the counter top 9.

Referring to FIGS. 2 and 3, the latch parts 34*a*, 34*b* are shaped the same as the hinge parts 23*a*, 23*b*. Many other configurations for latching the lid member 22 in the closed position can be envisaged by the skilled person, as demonstrated by the embodiment of FIGS. 10 to 12. For example, the lid member 22 may be closable about a hinge mechanism and a latch mechanism could hold the closed position, without requiring the lid member 22 to be shifted. In such an embodiment, the grooves 32, 36 could be done away with and a more traditional latching mechanism could be provided such as a resiliently deflected blocking mechanism that is unlatched by way of a push button. Such an embodiment, would not, however, realize the advantageous pivot and shift mechanism that does not require special tools to open and close the cover member, and it exposes a push button for tampering by customers. Such an embodiment would, however, still be able to achieve the pop off cover member, the improved mounting mechanism and the rotatable cover member amongst other disclosed advantageous features.

In the shown embodiment, the grooves 32, 36 are provided on the lid member 22, while the pins 25, 35 are provided on the frame member 21. It can be imagined, however, that constructions could be implemented where the pins are located on the lid member 22 and the recesses are located on the frame member 21.

The peg 13 of FIG. 4 has specially constructed features for achieving the purpose of securing the product housing 2 to the counter top 9 or other such wall member. Less sophisticated pegs could, however, be implemented. For example, a spring made of a wire-like member that is shaped into first and second diverging legs extending from a head portion wherein a notched region is located between the legs and the head portion could be used. In use, the outwardly diverging legs could be moved toward one another so as to enable them to fit through the mounting slots and then the head portion pushed until the notch portion is engaged with the sidewall defining the mounting slot to secure the wire peg in the projecting position.

In the shown embodiment, the product housing 2 is rectangular in cross section to accommodate a stack having a similar rectangular cross section with respect to the Z direction of the product housing 2 and the stacking direction of the stack. Thus, in the shown embodiments, the mounting slots 10 for receiving the pegs 13 and the engagement slots 30 for receiving the engagement tabs 29 are disposed on a long side of the rectangular cross section of the product housing since there is more room to accommodate them. Nonetheless, these features could be wholly or partially provided on the short sides 5 of the product housing 2. Further, depending on the shape of the cross section of the stacks of products to be dispensed, the shape of the cross section of the product housing 2 could be similarly adjusted.

The invention claimed is:

1. A product dispenser comprising a housing for housing dispensable products in a product reservoir defined by the housing and a cover member defining a dispensing opening through which the products are dispensed, wherein the cover member comprises a lid member and a support member and the lid member is openable relative to the support member about a hinge, wherein the cover member is removably mountable to the housing by at least one engagement member of the support member engaging at least one complementary engagement member of the housing, wherein the dispensing opening includes a hole present in the lid member, and wherein one of the at least one engagement member and the at least one complementary engagement member includes a protruding surface and the other includes a complementary recessed surface.

2. The product dispenser of claim 1, wherein the housing defines an opening and the support member defines an opening through which openings disposable products can be passed to fill the reservoir when the lid member is in an open position and which openings are partially closed by the lid member when it is in a closed position.

3. The product dispenser of claim 1, wherein the support member is in the form of a frame.

4. The product dispenser of claim 1, wherein the housing includes a flange and walls depending from the flange so that the flange can be placed against a counter top or wall member to which the dispenser is to be mounted and so that the depending walls can be passed through a cut-out in the counter top or wall member to be located in a cavity in or behind the counter top or wall member as the flange is seated against the counter top or wall member.

5. The product dispenser of claim 1, wherein at least one set of the at least one engagement member and the at least one complementary engagement member forms a snap fit when the cover member is mounted to the housing.

6. The product dispenser of claim 1, wherein a strength of connection of the hinge and a strength of connection of the at least one engagement member to the at least one complementary engagement member is such that when the lid member is opened to a stop position and further opening force is applied to the lid member, the at least one engagement member dismounts between the housing and the cover member before the force gets so great as to break the hinge.

7. The product dispenser of claim 6, wherein the support member comprises a proximal end at the hinge and a distal end relative to the hinge, wherein the support member includes at least two engagement members with at least one of the engagement members relatively adjacent the distal end and at least one of the engagement members relatively adjacent the proximal end for engaging the at least one complementary engagement member on the housing to removably mount the support member to the housing, and wherein the dispenser is such that the at least one distal engagement member or the at least one proximal engagement member of the housing disengages before the other of the at least proximal engagement member and the at least one distal engagement member disengages from the at least one complementary engagement member of the housing to provide a staged dismounting of the cover member from the housing.

8. The product dispenser of claim 1, wherein the lid member is openable to a position greater than 90° relative to the housing.

9. The product dispenser of claim 1, wherein the hinge includes a part associated with the support member and a part associated with the lid member, and wherein the support member part of the hinge is upstanding from a plane defined by a general body of the support member.

10. The product dispenser of claim 1, wherein a support member part of the hinge and a lid member part of the hinge are provided, at least in part, by a complementary pivot projection and pivot recess, one of which is formed in a peripheral lip depending from a general body of the lid member and the other of which is disposed on the support member.

11. The product dispenser of claim 1, wherein the lid member is openable with respect to the support member about the hinge until a stop position is reached at which a portion of the lid member comes into engagement with a portion of the support member, and wherein a further opening force tends to lift the support member from the product dispenser to disengage the complementary engagement member to thereby dismount the cover member from the product housing.

12. The product dispenser of claim 11, wherein the portion of the lid member is provided by a peripheral rim of the lid member depending from a general body of the lid member.

13. The product dispenser of claim 11, wherein the portion of the support member is provided by a protrusion from a general body of the support member, and wherein the protrusion forms an overhang against which the portion of the lid member comes into contact when the lid member is in the open position.

14. The product dispenser of claim 13, wherein a component of the hinge is disposed on an end of the overhang.

15. The product dispenser of claim 11, wherein the portion of the lid member is disposed on one side of the hinge and the majority of the lid member is disposed on the other side of the hinge.

16. The product dispenser of claim 1, wherein one of the at least one engagement member and the at least one complementary engagement member includes a member that resiliently deflects to allow the support member to be mounted to the product housing and resiliently reforms into a position in which the protruding and recessed surfaces interact to resist the support member from being removed from the product housing.

17. The product dispenser of claim 16, wherein at least one of the protruding and recessed surfaces is angled relative to a direction of mounting and removing the support member to and from the product housing so as not to be perpendicular thereto.

18. A cover member for a product housing of a product dispenser comprising:

a lid member comprising a dispensing opening through which products are dispensable, wherein the dispensing opening includes a hole present in the lid member, and a hinge connecting a support member and the lid member and about which the lid member is openable for refilling the product housing and closable for covering the dispensable products in the housing, wherein the support member includes at least one mechanical engagement member so that the cover member is removably mounted to the product housing of the dispenser, wherein the support member is frame shaped for seating against a planar upper surface of the product dispenser, wherein the frame borders an opening through which products can be passed to fill the product housing, wherein the support member has a top surface oriented toward the lid member, and wherein the lid member comprises a portion positioned so that as the lid member rotates about the hinge into open position, the portion of the lid member rotates to engage with the top surface of the support member to tend to tend to lift the support member from the housing.

19. The cover member of claim 18, wherein the at least one engagement member is one of a recess for receiving a resilient snap type member of the product housing for engaging the recess or a resilient snap type member for engaging a recess on the product housing.

20. The cover member of claim 19, wherein the recess defines a ledge against which a planar surface of the resilient engagement member seats.

21. The cover member of claim 18, wherein the portion of the lid member is provided by a skirting depending from a general body of the lid member.

22. The cover member of claim 18, wherein the portion of the lid member comes into engagement with the top surface of the support member so that further force in the opening direction of the lid member causes a force to be applied to the top surface of the support member by the portion of the lid member in a lifting direction with respect to the support member being lifted from the housing.

23. The cover member of claim 18, wherein the support member comprises a protrusion defining an overhang extending the top surface of the support member, and the portion of the lid member engages the top surface of the overhang when the lid member is in an open position.

24. The cover member of claim 23, wherein the overhang is spaced from the support member to accommodate rotation of the portion of the lid member during rotation of the lid member about the hinge.

25. The cover member of claim 18, wherein the hinge is disposed adjacent one end of the lid member so that a majority of the lid member is disposed on one side of the hinge, and wherein the portion of the lid member is disposed on the other side of the hinge.

26. The cover member of claim 25, wherein the portion of the lid member comes into engagement with the top surface of the support member after the majority of the lid member on one side of the hinge has rotated past a rotation of 90° in the opening direction.

27. The cover member of claim 18, wherein the portion of the lid member is provided by a peripheral lip of the lid member depending from a general body of the lid member.

28. The cover member of claim 18, wherein the hinge comprises a pivot pin component and a pivot pin receiving component, and wherein one of the hinge components is disposed on the support member and one of the hinge components is disposed on the lid member.

29. The cover member of claim 28, wherein the lid member comprises a peripheral lip depending from a general body of the lid member, and wherein one of the hinge components is disposed on an inner surface of the peripheral lip.

* * * * *